US010730297B2

(12) United States Patent
Yap et al.

(10) Patent No.: US 10,730,297 B2
(45) Date of Patent: Aug. 4, 2020

(54) PRINTHEAD PRESSURE ADJUSTMENT FOR A PRINTING APPARATUS

(71) Applicant: Datamax-O'Neil Corporation, Altamonte Springs, FL (US)

(72) Inventors: Yaw Horng Yap, Singapore (SG); Chin Young Wong, Singapore (SG); Ching Hong Chua, Singapore (SG); Eng Hing Lim, Singapore (SG)

(73) Assignee: Datamax-O'Neil Corporation, Altamonte Springs, FL (US)

( * ) Notice: Subject to any disclaimer, the term of this patent is extended or adjusted under 35 U.S.C. 154(b) by 0 days.

(21) Appl. No.: 16/014,300

(22) Filed: Jun. 21, 2018

(65) Prior Publication Data

US 2019/0389211 A1 Dec. 26, 2019

(51) Int. Cl.
*B41J 2/145* (2006.01)
*B41J 2/14* (2006.01)

(52) U.S. Cl.
CPC ..... *B41J 2/1433* (2013.01); *B41J 2/145* (2013.01)

(58) Field of Classification Search
None
See application file for complete search history.

(56) References Cited

U.S. PATENT DOCUMENTS 3,205,863 A 9/1965 Kent
8,985,730 B2 * 3/2015 Gotschewski ..... B41J 29/13 347/17
9,132,675 B1 * 9/2015 Yu ..... B41J 2/32

* cited by examiner

*Primary Examiner* — Matthew Luu
*Assistant Examiner* — Tracey M McMillion
(74) *Attorney, Agent, or Firm* — Alston & Bird LLP

(57) ABSTRACT

Provided herein is a printing apparatus that includes a printhead assembly and a plurality of printhead pressure load modules that are adjustable on a shaft of a printhead pressure load assembly and engaged with a printhead member. The printhead pressure load module has a hollow housing, a plunger member, and a rotary cam. The plunger member and the rotary cam are movably engaged in the hollow housing. The rotary cam includes a plurality of channel members defined at an outer surface. Each channel member has a depth that is different from a depth of an adjacent channel member. A movement of the plunger member inwardly through the hollow housing defines a position of the rotary cam along the longitudinal axis with respect to the hollow housing. Position change of the rotary cam defines a force that acts on a pressure contact member and adjusts a load on the printhead assembly.

20 Claims, 12 Drawing Sheets

PRINTHEAD PRESSURE ADJUSTMENT FOR A PRINTING APPARATUS

TECHNOLOGICAL FIELD

Example embodiments of the present disclosure relate generally to printers, and more particularly, to a printhead for a thermal printing apparatus.

BACKGROUND

Printing apparatuses, such as copiers, printers, facsimile devices or other systems, are capable of reproducing content, visual images, graphics, texts, etc. on a print media. Some examples of the printing apparatuses may include, but not limited to, thermal printers, inkjet printers, laser printers, and/or the like.

A conventional industrial thermal printer often includes a thermal printhead having multiple resistor elements, i.e. heating elements, in burn lines. During operation, passage of electric current through such resistor elements energizes the resistor elements to perform a printing operation. The energized resistor elements generate heat energy to induce markings on print media by selectively heating specific areas of print media or by heating a thermal transfer media (e.g., a ribbon) for various printing applications, such as label printing. Examples of the thermal printers may include thermal transfer printers and direct thermal printers. Typically, in thermal transfer printer, content is printed on the media by heating a coating of a ribbon so that the coating is transferred to the media. It contrasts with the direct thermal printing where no ribbon is present in the process.

The print media utilized for such thermal printers may correspond to a specific type of print media based on various characteristics, such as size, width, thickness, coating, and the like. According to variations observed in printing output and to support different types of print media, the industrial thermal printers may be required to adjust the printhead pressure load on the thermal printhead. Such adjustment of the printhead pressure load on the thermal printhead may require a sequence of actions to be performed or need a specialized tool, which in turn becomes difficult to operate and thus, not user-friendly.

Applicant has identified a number of deficiencies and problems associated with conventional printing apparatuses. Through applied effort, ingenuity, and innovation, many of these identified problems have been solved by developing solutions that are included in embodiments of the present disclosure, many examples of which are described in detail herein.

BRIEF SUMMARY

Various embodiments provide printhead pressure load assemblies in printing apparatuses for providing pressure adjustment on printhead members so that the quality of thermal printing is optimal. In one embodiment, a printing apparatus includes a printhead assembly extending a printhead width in a direction transverse to a web direction. The printing apparatus further includes a plurality of printhead pressure load modules adjustable on a shaft of a printhead pressure load assembly and engaged with the printhead member, the shaft extending in the direction transverse to the web direction. Each of the plurality of printhead pressure load modules includes a hollow housing having fixed flanges defined on an inner surface and extending along a longitudinal axis of the printhead pressure load module.

Each of the plurality of printhead pressure load modules further includes a plunger member, slidably mounted through a top end of the hollow housing, wherein the plunger member has a cap portion and leg portions, the leg portions extending along the longitudinal axis and movably positioned adjacent to the fixed flanges. Each of the plurality of printhead pressure load modules further includes a rotary cam movably engaged in the hollow housing and coupled with the cap portion of the plunger member through a first biasing member. Opposite ends of the biasing member are secured to a bottom surface of the cap portion and a top surface of the rotary cam, respectively. The rotary cam includes a plurality of channel members defined at an outer surface of the rotary cam and extending from a top end of the rotary cam along the longitudinal axis, each channel member having a depth that is different from a depth of an adjacent channel member. A movement of the plunger member inwardly through the top end of the hollow housing and a resultant engagement of at least the fixed flanges with two diametrically opposite channel members having defined depths defines a position of the rotary cam along the longitudinal axis with respect to the top end of the hollow housing.

Each of the plurality of printhead pressure load modules further includes a pressure contact member that is positioned towards a bottom end of the hollow housing and engaged with a bottom end of a cap portion of the rotary cam through a second biasing member such that a change in the position of the rotary cam defines a force that acts on the pressure contact member through the second biasing member and causes the pressure contact member to adjust a load on the printhead assembly engaged with the printhead pressure load module.

The plurality of channel members includes at least three pairs of channel members, each pair of the at least three pairs of channel members have identical channel members, equidistant from an axis of rotation of the rotary cam, and defined diametrically opposite to each other on the outer surface of the rotary cam. A periphery of each of the plurality of channel members is defined by one or more longitudinal surfaces and one or more chamfered surfaces, a portion of the periphery defining the depth of the corresponding channel member.

One of the one or more longitudinal surfaces in each channel member is a stopping longitudinal surface configured to stop a rotational movement of the rotary cam. At least one of the one or more chamfered surfaces in each channel member is defined along a helical path around the outer surface of the rotary cam that defines a depth of the corresponding channel member. Others of the one or more chamfered surfaces in each channel member extend from the top surface of the rotary cam to other longitudinal surface of the corresponding channel member.

The at least three pairs of the plurality of channel members are engaged successively by the fixed flanges that defines the position of the rotary cam along the longitudinal axis with respect to the top end of the hollow housing. The position of the rotary cam along the longitudinal axis defines a magnitude of the force that acts on the pressure contact member through the second biasing member. A longitudinal surface of a channel member is defined by an upper edge of a chamfered surface of a channel member of an axially backward channel member and a lower edge of a chamfered surface of the channel member.

In an instance when both the leg portions and the fixed flanges are engaged in the channel member, the longitudinal surface of the channel member is a stopping surface abutting the leg portion. In an instance when the leg portion is withdrawn due to movement of the plunger member outwardly under the influence of the first biasing member, the longitudinal surface of the channel member acts as a stopping surface abutting the fixed flange.

A top portion of each of the fixed flanges is extended as a circumferentially structured stop member defined on the inner surface of the hollow housing, and the ending portion is having a chamfered surface that is configured to abut a chamfered surface of the rotary cam and move the rotary cam in a downward direction.

In an embodiment, the hollow housing includes a longitudinal window exposing current position of the rotary cam. In various embodiments, the printhead member is adjusted in one of a printing position or loading position. Further, a printhead bracket of the printhead member includes a horizontal surface and an inclined surface.

In an instance when the printing apparatus is in printing mode and the printhead member is adjusted in the printing position, the plurality of printhead pressure load modules are aligned vertically along the longitudinal axis and the pressure contact members are engaged with the horizontal surface of the printhead bracket. In an instance when the printing apparatus is in loading mode and the printhead member is adjusted in the loading position, the plurality of printhead pressure load modules rotate in reverse web direction around the shaft and the pressure contact members are slidably engaged with the inclined surface of the printhead bracket.

The printhead pressure load module includes the hollow housing having fixed flanges defined on the inner surface and extending along the longitudinal axis of the printhead pressure load module. The plunger member is slidably mounted through a top end of the hollow housing. The plunger member has a cap portion and leg portions, the leg portions extending along the longitudinal axis and movably positioned adjacent to the fixed flanges. The rotary cam movably engaged in the hollow housing and coupled with an inner surface of the cap portion of the plunger member through a first biasing member secured to the cap portion, the rotary cam including a plurality of channel members defined at an outer surface of the rotary cam and extending from a top end of the rotary cam along the longitudinal axis, each channel member having a depth that is different from a depth of an adjacent channel member. A movement of the plunger member inwardly through the top end of the hollow housing and a resultant engagement of at least the fixed flanges with two diametrically opposite channel members having defined depths defines a position of the rotary cam along the longitudinal axis with respect to the top end of the hollow housing. The pressure contact member is positioned towards a bottom end of the hollow housing and engaged with a bottom end of cap portion of the rotary cam through a second biasing member such that a change in the position of the rotary cam defines a force that acts on the pressure contact member through the second biasing member and causes the pressure contact member to adjust a load on a printhead assembly engaged with the printhead pressure load module.

The above summary is provided merely for purposes of summarizing some exemplary embodiments to provide a basic understanding of some aspects of the disclosure. Accordingly, it will be appreciated that the above-described embodiments are merely examples and should not be construed to narrow the scope or spirit of the disclosure in any way. It will be appreciated that the scope of the disclosure encompasses many potential embodiments in addition to those here summarized, some of which are further explained within the following detailed description and its accompanying drawings.

BRIEF DESCRIPTION OF THE DRAWINGS

The description of the illustrative embodiments may be read in conjunction with the accompanying figures. It will be appreciated that for simplicity and clarity of illustration, elements illustrated in the figures have not necessarily been drawn to scale. For example, the dimensions of some of the elements are exaggerated relative to other elements. Embodiments incorporating teachings of the present disclosure according to one or more embodiments of the present disclosure are shown and described with respect to the figures presented herein, in which.

DETAILED DESCRIPTION

Figure 1A:
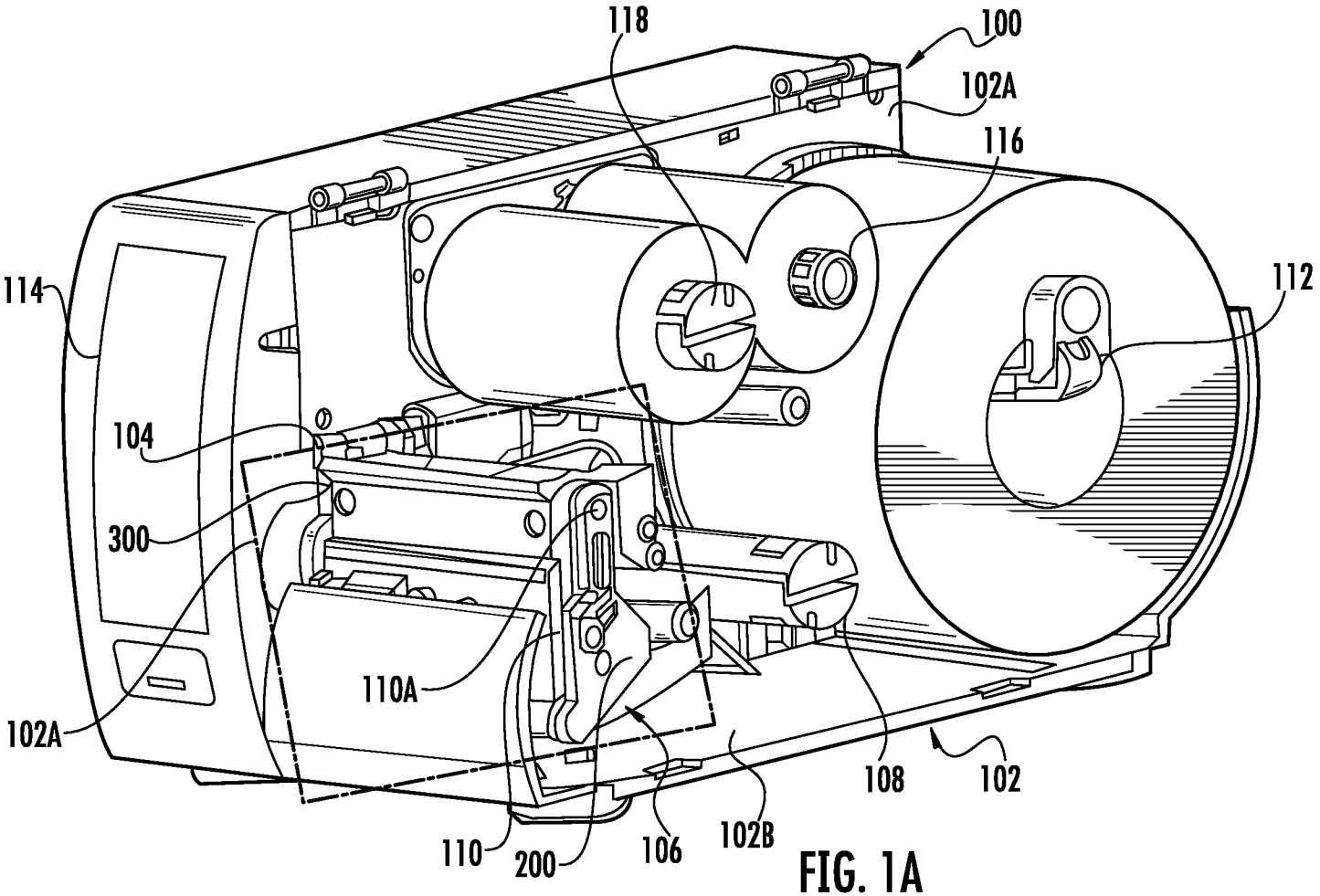
FIG. 1A illustrates a perspective view of a printing apparatus, in accordance with one or more embodiments of the present disclosure.

Some embodiments of the present disclosure will now be described more fully hereinafter with reference to the accompanying drawings, in which some, but not all embodiments of the disclosure are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout. Terminology used in this patent is not meant to be limiting insofar as devices described herein, or portions thereof, may be attached or utilized in other orientations.

The term "comprising" means including but not limited to, and should be interpreted in the manner it is typically used in the patent context. Use of broader terms such as comprises, includes, and having should be understood to provide support for narrower terms such as consisting of, consisting essentially of, and comprised substantially of.

The phrases "in one embodiment," "according to one embodiment," and the like generally mean that the particular feature, structure, or characteristic following the phrase may be included in at least one embodiment of the present disclosure, and may be included in more than one embodiment of the present disclosure (importantly, such phrases do not necessarily refer to the same embodiment).

The word "exemplary" is used herein to mean "serving as an example, instance, or illustration." Any implementation described herein as "exemplary" is not necessarily to be construed as preferred or advantageous over other implementations.

If the specification states a component or feature "may," "could," "should," "would," "preferably," "possibly," "typically," "optionally," "for example," "often," or "might" (or other such language) be included or have a characteristic, that particular component or feature is not required to be included or to have the characteristic. Such component or feature may be optionally included in an embodiment, or it may be excluded.

In some example embodiments, a printhead used in a thermal printer includes multiple resistors or heating elements in a burn line disposed on a substrate. With the passage of electric current for controlled time periods, such resistor elements may be energized to perform a printing operation. As a thermal printer may be used to print a variety of substrates, it is advantageous to be able to adjust the pressure applied to the printhead. For example, the pressure applied to the printhead may affect the location of the printhead with respect to the substrate and/or the pressure applied to the substrate by the printhead during the printing operation.

Thus, in various example embodiments a printhead pressure adjustment is provided. The word "print media" is used herein to mean a printable medium, such as a page or a paper, on which content, such as graphics, text, and/or visual images, may be printable. The print media may correspond to a continuous media that may be loaded in a printing apparatus in form of a roll or a stack. In some embodiments, the scope of the disclosure is not limited to having a continuous media. In some embodiments, the print media may be divided into one or more portions through perforations defined along a width of the print media. In an alternate embodiment, the print media is divided into the one or more portions through one or more marks that are defined at a predetermined distance from each other, along the length of the print media. In an example embodiment, a contiguous stretch of the print media, between two consecutive marks or two consecutive perforations, corresponds to a portion of the print media. In some embodiments, the print media may correspond to a thermal media on which the content is printed on application of heat on the print media itself. In alternate embodiments, the print media may correspond to a liner media, a liner-less media, and/or the like.

As described herein, a first direction in which the print media exits from the printing apparatus, as disclosed, corresponds to web direction. A second direction that is horizontally orthogonal/transverse to the web direction corresponds to cross-web direction.

Typically, printing apparatuses, such as thermal printers, inkjet printers, or laser printers, reproduce content, visual images, graphics, texts, etc. on a print media. A conventional industrial thermal printer often includes a thermal printhead having multiple resistor elements, i.e. heating elements, in burn lines. During operation, passage of electric current through such resistor elements generate heat energy to induce markings on the print media by selectively heating specific areas of the print media or by heating a thermal transfer media (e.g., a ribbon) for various printing applications, such as label printing. For such printing, the printhead is positioned such that the print media, typically supplied by a media spool, is held in a pressure contact, and sandwiched between the burn line(s) of the printhead and the platen roller. The platen roller is rotationally driven and heating elements in burnlines are selectively activated, in order to suitably produce the desired image.

The print media utilized for such thermal printers may correspond to a specific type of print media based on various characteristics, such as size, width, thickness, coating, and the like. According to variations observed in printing output and to support different types of print media, the industrial thermal printers may be required to adjust printhead pressure load on the thermal printhead. To maintain an optimum level of print quality, the printhead pressure load is suitably distributed over the region of the printhead under which the media traverses, to prevent uneven printhead pressure load on the thermal printhead. In other words, area of pressure contact developed by the printhead acting through the print media and on to the platen roller must be adequate to produce appropriate contact between the printhead and print media, thereby resulting in thermal energy transfer for proper image formation. Insufficient pressure contact can cause misprinted areas of image on the print media. Conversely, excessive pressure contact can cause increased abrasion and wear-and-tear of the printhead, resulting in premature degradation of printhead and diminished print life.

Existing pressure adjustment methods/mechanisms are cumbersome and not very user-friendly. Such methods/mechanisms require a sequence of actions to be performed by an operator. Further, the aid of a specialized tool may be required by the operator, which in turn may be difficult to operate/handle.

Mostly, for a particular type of print media, there is no standard printhead load or pre-specified setting levels of pressure load modules. The pressure load modules are adjusted with screws or other such mechanisms to evenly balance the pressure load modules. The operator handling the printing apparatus iteratively performs hit-and-trial pressure load settings to ascertain position and load adjustment of the pressure load modules, then operate the printing apparatus to determine if print quality is acceptable. This iterative technique, may take substantial time to achieve optimal print quality, thereby resulting in the print media wastage.

Thus, there is a need for a feature in printing apparatus that provides flexibility to adjust the printhead pressure load of the printing apparatus in the most seamless and user-friendly manner, for example, by just pressing and releasing a push button plunger. The printhead pressure adjustment assembly, as disclosed herein, includes at least two printhead pressure adjustment modules. The printhead pressure adjustment modules may be shifted to left or right over a horizontal shaft to distribute the printhead pressure load in the cross-web direction. Based on a type of print media and/or a print feedback, the push button plunger is deflected (pressed and released) to adjust the printhead pressure adjustment modules to change the printhead pressure load on the print media. The printhead pressure load may be changed to a specified setting, e.g. Low, Medium or High, via a operating the plunger member of the printhead pressure adjustment module. Once the push button plunger has set the printhead pressure load to high setting, an additional push and release of the push button plunger may cycle the printhead pressure load back to the lowest setting. The press and release operation of the push button plunger may be manual or actuated by a controller for an automatic operation. Such a user-friendly and easy mechanism for adjusting the printhead pressure load of the printing apparatus may relieve the user from the otherwise unproductive and cumbersome activity of setting the printhead pressure load for an optimal printing output.

Having described example embodiments, the design of the various devices performing various example operations is provided below. The components illustrated in the figures represent components that may or may not be present in various embodiments of the disclosure described herein such that embodiments may include fewer or more components than those shown in the figures while not departing from the scope of the disclosure.

FIG. 1A illustrates a perspective view of a printing apparatus 100, in accordance with one or more embodiments of the present disclosure. The printing apparatus 100 may include a casting 102, a printing assembly 104, a thermal ink printer media take-up assembly module 108, a media supply hub 112, and a display assembly 114. The printing apparatus 100 may further include a ribbon supply assembly 116, and a ribbon take-up assembly 118.

In some embodiments, various components in the printing apparatus 100 may be independently attachable to and detachable from the casting 102. As such, the printing apparatus 100 may be easily and quickly converted from an ink ribbon printer to a thermal ink printer and vice-versa by installing the appropriate printhead assembly and the appropriate media take-up assembly module into the printing apparatus 100. Additionally, different circuit boards may be installed for selectively controlling operation of the printing apparatus 100. For example, different circuit boards or additional circuit boards may be installed to convert the printing apparatus 100 from the thermal ink printer to the ink ribbon printer or vice-versa.

The casting 102 may operate as a support body for the printing apparatus 100 and may include a central support member 102A and a base member 102B, which may be monolithically formed from a heat conductive material, such as cast aluminum, ceramics, plastics, sheet metal, and the like. By casting the central support member 102A and the base member 102B monolithically, heat dissipation from within the printing apparatus 100 may be improved, in some examples. The casting 102 may include various recesses configured to receive each of the assemblies in a specific orientation such that when each of the assemblies is secured to the casting 102, the assemblies are supported in an operative configuration.

The printing assembly 104 includes various assemblies, such as, but not limited to, a printhead assembly 200 and a printhead pressure load assembly 300, that in conjunction with each other, are configured to perform a printing operation. The printhead assembly 200 is described in detail in FIGS. 2A and 2B. The printhead pressure load assembly 300 is described in detail in FIGS. 3A-3D.

The support block assembly 106 may include various support portions, one or more of which may be releasably engaged with a portion of a printhead lever arm 110. The support block assembly 106 may include various components, such as a platen mounting block, a platen assembly, a retainer bracket, a media guide, and a tear bar (not shown in FIG. 1A). The support block assembly 106 may further be a replaceable part in the printing apparatus 100.

The thermal ink printer media take-up assembly module 108 may include at least a hub assembly (not shown in FIG. 1A) configured to support a media take-up roll. The thermal ink printer media take-up assembly module 108 may be operable when the printing apparatus 100 is operated as a thermal ink printer.

The media supply hub 112 may include at least a hub and an adjustable retaining member (not shown in FIG. 1A). After the media supply roll is positioned on the hub, the adjustable retaining member may be pivoted back to a position perpendicular to the hub and slid into contact with the media supply roll to retain the media supply roll on the hub.

The display assembly 114 may include a module having a display (e.g., a light-emitting diode (LED) display, an organic light-emitting diode (OLED) display, a liquid-crystal display (LCD) display, a cathode ray tube (CRT), or the like) and a display casing. The display assembly 114 may present the status of the printing apparatus 100 and include operational and menu keys which may allow the user to change parameters of the printing apparatus 100 that control operation of the printing apparatus 100. The display assembly 114 may be configured to display commands and the parameters of operation in multiple languages.

The ribbon supply assembly 116 and the ribbon take-up assembly 118 may, in some embodiments, be operable in an instance in which the printing apparatus 100 is operated as a thermal transfer printing apparatus or an ink ribbon printer. The ribbon take-up assembly 118 may include a hub that is driven by the drive mechanism of printing apparatus 100 to unwind ribbon from the spool of ribbon positioned on the hub assembly of ribbon supply assembly 116. As ribbon is unwound from the hub assembly, torque from the spool of ribbon is translated from the spool of ribbon, through hub portions and torsion springs to a ribbon supply shaft (not shown in FIG. 1A). Accordingly, a back tension is created in the ribbon as each torsion spring is put in torque. Because the hub portions are independently rotatable about the ribbon supply shaft, the amount of back tension created in the ribbon is proportional to the width of the spool of ribbon. The ribbon take-up assembly 118 may be configured and adapted to receive the ribbon.

Figure 2A:
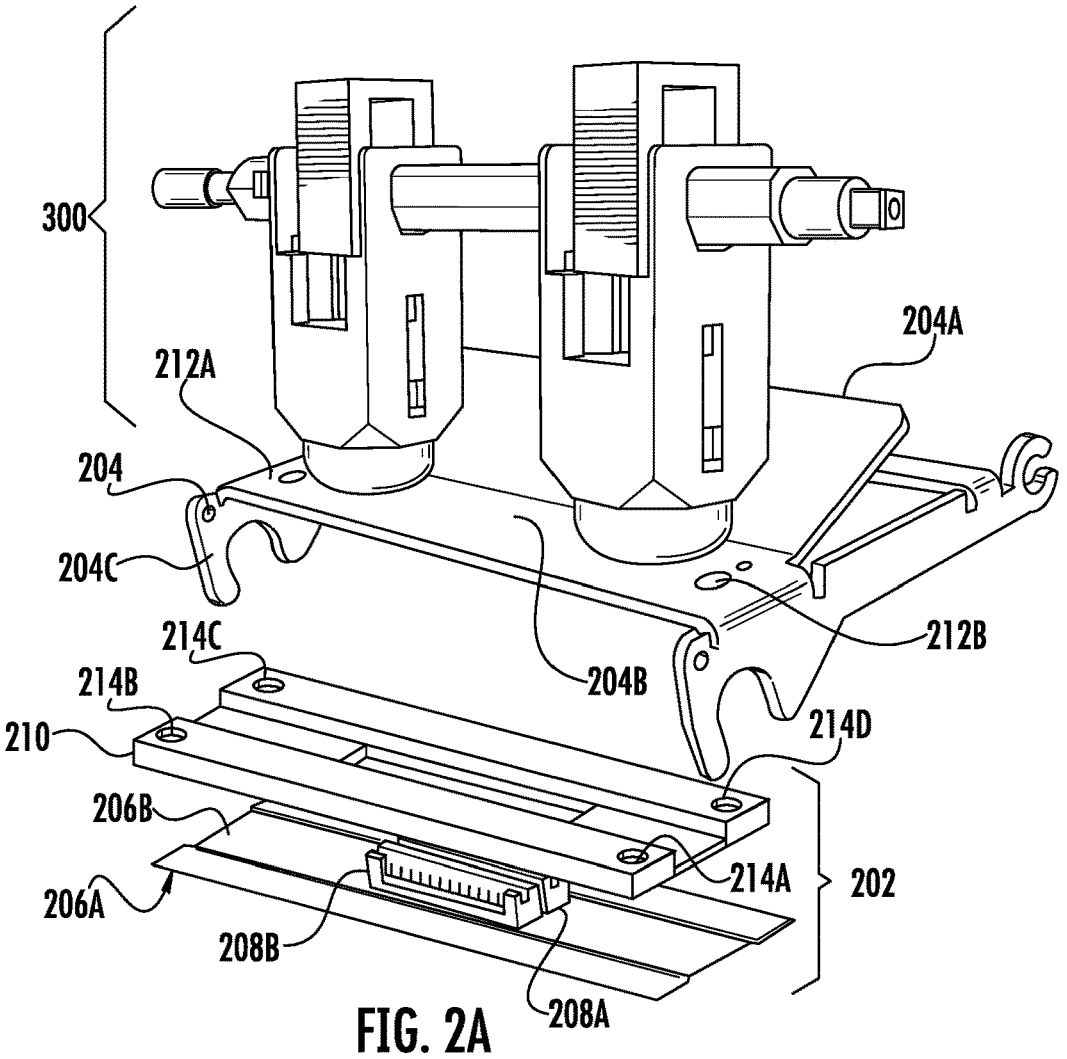
FIG. 2A illustrates a perspective view of a printhead assembly, in accordance with one or more embodiments of the present disclosure.
Figure 2B:
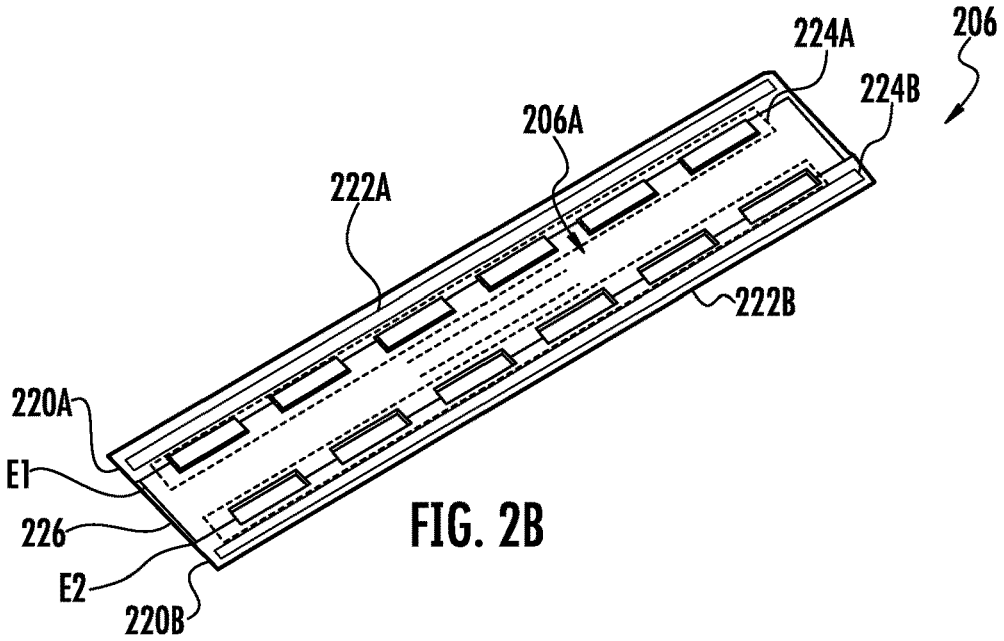
FIG. 2B illustrates a perspective view of a printhead of the printhead assembly of FIG. 2A, in accordance with one or more embodiments of the present disclosure.

An example printhead assembly 200, as described in detail in FIGS. 2A and 2B, may be configured to mate with a platen assembly (not shown in FIG. 1A). The printhead assembly 200 may be pivotably mounted in the printing apparatus 100. In some embodiments, the printhead assembly 200 may form an integral unit or module that is bolted to the casting 102 to secure the printhead assembly 200 within the printing apparatus 100.

Figure 1B:
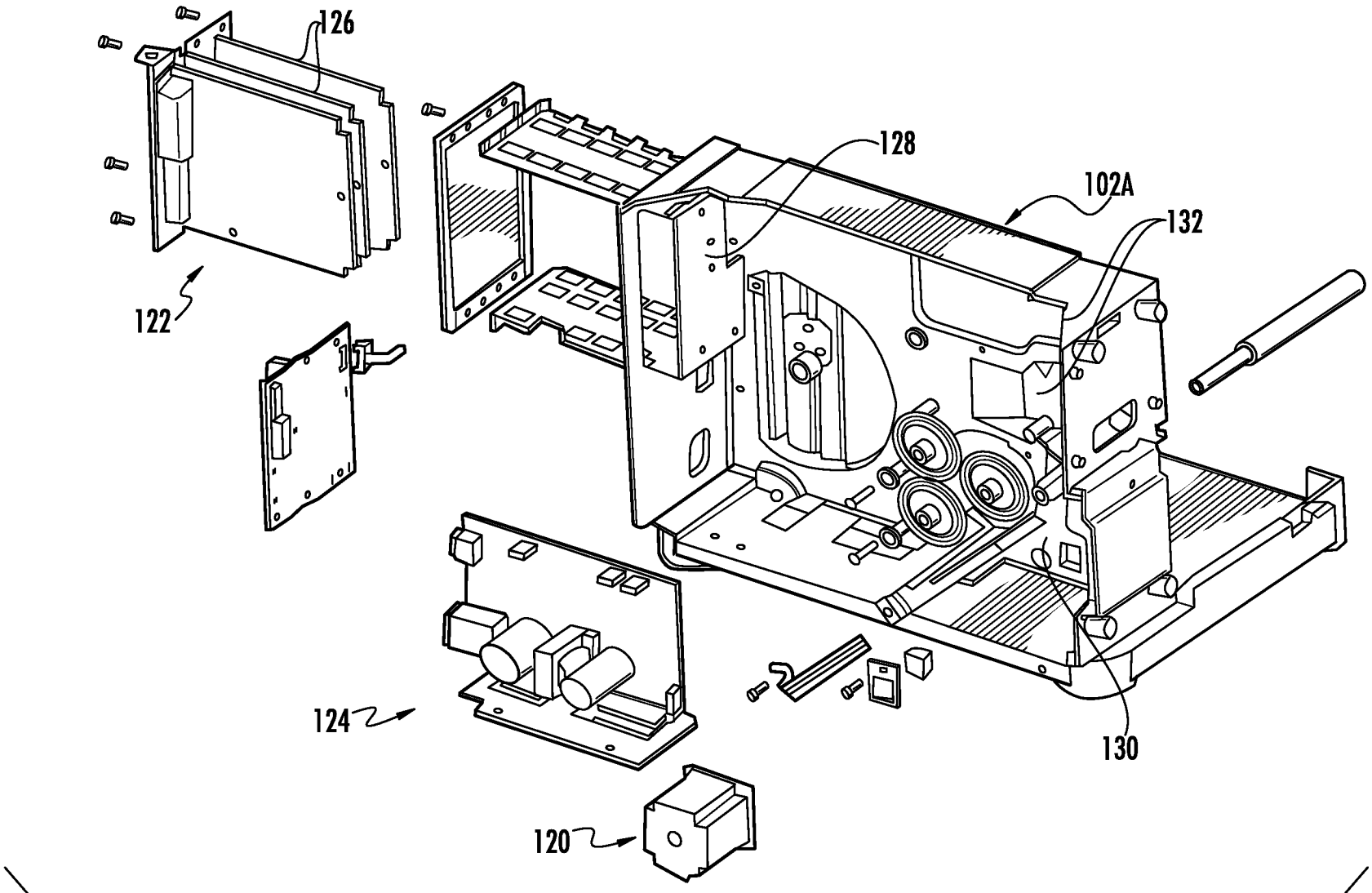
FIG. 1B illustrates an exploded perspective view of the printing apparatus of FIG. 1A, in accordance with one or more embodiments of the present disclosure.

FIG. 1B illustrates an exploded perspective view of the printing apparatus 100 of FIG. 1A, in accordance with one or more embodiments of the present disclosure. As illustrated, the electrical and drive components may be secured to the opposite side of the central support member 102A of the casting 102. The electrical and drive components may include a stepper motor assembly 120, electronic circuitry 122, and an electric drive assembly 124 that are secured to the central support member 102A on a side opposite to the printing components. The electronic circuitry 122 may include one or more circuit boards 126 that may be installed in the printing apparatus 100 by sliding the circuit boards 126 through an opening 128 formed in the casting 102. The circuit boards 126 may be chosen to suit a specific printing operation to be performed. For example, the electronic circuitry 122 may be changed to accommodate different communications interfaces. Alternatively, software can be downloaded via a mechanism, such as COM port or CUPS printer driver, to control a specific printing application. The casting 102 as illustrated may further include a first mounting location 130 and a second mounting location 132 that may be configured to receive the stepper motor assembly 120. While the printing apparatus 100 as illustrated in FIGS. 1A-1B is often configured for operation in commercial or industrial printing applications, the present disclosure contemplates that the printing apparatus 100 may be equally applicable to personal or desktop use.

FIG. 2A illustrates a perspective partial view of the printhead assembly 200, in accordance with one or more embodiments of the present disclosure. With reference to FIG. 2A, the printing assembly 104 of the printing apparatus 100 may include a portion of the printhead pressure load assembly 300 and at least a printhead 202 and a printhead bracket 204 of the printhead assembly 200. There is further shown an inclined surface 204A of the printhead bracket 204 to provide a slidable movement to the printhead pressure load assembly 300 when the printhead assembly 200 is lifted upwards using the printhead lever arm 110.

In some embodiments, the printhead 202 may further include a printhead plate 206 and a heat sink 210. The printhead plate 206 may define two opposite surfaces, a first surface 206A and a second surface 206B (as illustrated in FIG. 2A). The first surface 206A may correspond to the bottom surface of the printhead plate 206, the perspective view of which has been illustrated in FIG. 2B. The second surface 206B may correspond to the top surface of the printhead plate 206, the perspective view of which has been illustrated in FIG. 2A. The second surface 206B may be configured to support the heat sink 210.

In some embodiment, the printing apparatus 100 may be configured as a thermal transfer printing apparatus or a direct thermal printing apparatus. By way of example, a direct thermal printing may use specially treated label stock that contains dyes configured to appear black upon application of heat and pressure. In such an embodiment, the heating elements of the one or more burn lines of the first surface 206A of the printhead plate 206 (e.g., discussed hereinafter with reference to FIGS. 2A and 2B) may be in direct contact with the media, such as the label stock. In another alternative embodiment, the printing apparatus 100 may be configured as an ink ribbon printer or a thermal transfer printing apparatus. By way of example, thermal transfer printing requires the use of a ribbon substrate having ink that is transferred onto a media upon application of heat and/or pressure to the ribbon substrate. In such an embodiment, the first surface 206A of the printhead plate 206 may be in direct contact the ink ribbon and the ink ribbon may be in direct contact with the media, such as the label stock.

In some embodiments, the second surface 206B of the printhead plate 206 may include a plurality of connectors, such as connectors 208A and 208B. The connectors 208A and 208B positioned on the second surface 206B may define extending contact pins such that the printhead 202 may be secured within the printhead bracket 204 in one of the first position or the second position for performing a printing operation. Once the printhead 202 is secured within the printhead bracket 204 in one of the first position or the second position, a mating connector (not shown) may connect with the one of the first connector 208A or the second connector 208B. For example, in some embodiments, the connector 208A may be configured to secure the printhead 202 within the printhead bracket 204 in the first position for performing the printing operation such that the mating connector is connected to the first connector 208A. In another example, the connector 208B may be configured to secure the printhead 202 within the printhead bracket 204 in the second position for performing the printing operation such that the mating connector is connected to the second connector 208B.

In an alternative or additional embodiment, the second surface 206B of the printhead plate 206 may include only one connector (not shown) that may secure the printhead 202 within the printhead bracket 204, in one of the first position or the second position for performing the printing operation. Consequently, the single connector may connect the printhead 202 with the mating connector in the first position or the second position for performing the printing operation.

With continued reference to FIG. 2A, the printhead bracket 204 may be formed as a support housing configured to secure the printhead assembly 200 to an engagement member of the casting 102 of the printing apparatus 100. The printhead 202 may be movably received by the printhead bracket 204 in one of the first position or the second position. Structurally, in one embodiment, the printhead 202 may be secured within the printhead bracket 204 (in the first position) by screws which are positioned within a set of slots 212A and 212B (formed in the printhead bracket 204) and a corresponding first set of slots 214A and 214B (formed along one longitudinal edge of the printhead 202). In another embodiment, the printhead 202 may be secured within the printhead bracket 204 (in the second position) by the screws which are positioned within the first set of slots 212A and 212B (formed in the printhead bracket 204) and another second set of slots 214C and 214D (formed along the opposite longitudinal edge of the printhead 202). The printhead bracket 204 may include a pair of pivot members which are slidably positioned in vertical slots in a printhead pivot. As the printhead bracket 204 pivots in the direction of the printhead mount and the media positioned within the printhead assembly 200, the printhead bracket 204 may be secured to the engagement member of the casting 102. The engagement between the printhead bracket 204 and the engagement member cams the pivot members upwardly in the vertical slots to lift the backend of the printhead bracket 204 to allow for substantially parallel closure of the printhead bracket 204 onto the printhead mount.

FIG. 2B illustrates a perspective view of the printhead 202 of the printhead assembly of FIG. 2A, in accordance with one or more embodiments of the present disclosure. FIG. 2B is described in conjunction with FIG. 2A. With reference to FIG. 2B, the first surface 206A of the printhead plate 206 is illustrated. For illustrative purposes, the printhead plate 206 is illustrated in FIG. 2B to be in a rectangular shape. Although described herein with reference to a printhead plate 206 having a rectangular shape, the present disclosure contemplates that the printhead plate 206 may have a different shape, such as square shape, without deviation from the scope of the disclosure.

The first surface 206A may support a first substrate 220A and a second substrate 220B. In an embodiment, the first substrate 220A may define at least heating elements of a first burn line 222A disposed adjacent to a first longitudinal edge "E1" of the printhead plate 206. The second substrate 220B may define at least heating elements of a second burn line 222B disposed adjacent to a second longitudinal edge "E2" of the printhead plate 206. The first longitudinal edge "E1" and the second longitudinal edge "E2" are located parallel and opposite to one another. Said differently, the first substrate 220A and the second substrate 220B are substantially parallel to the longitudinal edges "E1" and "E2", respectively.

In an example embodiment illustrated in FIG. 2B, the two longitudinal edges "E1" and "E2" of the first surface 206A of the printhead plate 206 support the substrates 220A and 220B, respectively, as long rectangular shapes. The substrates 220A and 220B may, in some embodiments, be made of insulating materials, such as alumina ceramic. Although described herein with reference to substrates 220A and 220B made of alumina ceramic, the present disclosure contemplates that the substrates 220A and 220B may be made of other such insulating materials, without deviation from the scope of the disclosure.

The heating elements of the first burn line 222A may be defined in a longitudinal direction along and adjacent to the first longitudinal edge "E1" of the first surface 206A of the printhead plate 206. In an embodiment, the heating elements of the first burn line 222A may be selectively activated, by a control unit (e.g., an external printhead control circuit) of the printing apparatus 100, when the printhead bracket 204 receives the printhead 202 in the first position to perform the printing operation. Thus, in the first position, the printhead 202 is secured within the printhead bracket 204 such that the heating elements of the first burn line 222A are aligned with a proximal end of the printhead bracket 204 and the heating elements of the second burn line 222B are aligned with a distal end of the printhead bracket 204. Further, in the first position, the printhead bracket 204 may be configured to preclude operation of the heating elements of the second burn line 222B.

Similarly, the heating elements of the second burn line 222B may be defined in a longitudinal direction along and adjacent to the first longitudinal edge "E2" of the first surface 206A of the printhead plate 206. In an embodiment, the heating elements of the second burn line 222B may be selectively activated, by the control unit, such as the external printhead control circuit, of the printing apparatus 100, when the printhead bracket 204 receives the printhead 202 in the second position to perform the printing operation. Thus, in the second position, the printhead 202 is secured within the printhead bracket 204 such that the heating elements of the second burn line 222B are aligned with a proximal end of the printhead bracket 204 and the heating elements of the first burn line 222A are aligned with a distal end of the printhead bracket 204. Further, in the second position, the printhead bracket 204 may be configured to preclude operation of the heating elements of the first burn line 222A.

A plurality of driver IC chips 224 and a Flexible Print Circuit (FPC) 226 on the first surface 206A of the printhead plate 206 are further illustrated in FIG. 2B. The plurality of driver IC chips 224 may include a first set of driver IC chips 224A and a second set of driver IC chips 224B. The first set of driver IC chips 224A may be disposed in parallel along the first longitudinal edge "E1" on the printhead plate 206 and the second set of driver IC chips 224B may be disposed in parallel along the second longitudinal edge "E2" on the printhead plate 206. In an embodiment, the first set of driver IC chips 224A may be disposed in parallel along the first longitudinal edge "E1" on the printhead plate 206 to selectively control and drive the heating elements of the first burn line 222A when the printhead 202 is secured within the printhead bracket 204 in the first position for performing the printing operation. In another embodiment, the second set of driver IC chips 224B may be disposed in parallel along the second longitudinal edge "E2" on the printhead plate 206 to selectively control and drive the heating elements of the second burn line 222B when the printhead plate 206 is secured within the printhead bracket 204 in the second position for performing the printing operation.

The FPC 226 may, in some embodiments, include circuitry on a semi-crystalline polymer, such as a polyimide film, that may be utilized as a connector circuit for leading a circuit terminal, formed on the two substrates 220A and 220B, to an external printhead control circuit (not shown). The FPC 226 is connected to the circuit terminal by soldering or by means of an adhesive material that may have dispersed electroconductive particles. In an embodiment, the two substrates 220A and 220B and the FPC 226 may be bonded with each other by a known means, for example, an adhesive containing dispersed electroconductive particles, to form the printhead plate 206.

As illustrated, the second surface 206B of the printhead plate 206 may support the heat sink 210 and may define a housing including a holding surface configured to securely hold the printhead 202 to an interface (e.g., via an adhesive, magnet, hook and loop connectors, or the like). The heat sink 210 may be formed from an extruded heat conductive material, such as aluminum, to facilitate the removal of heat generated by the printhead 202 during the printing operation. However, other materials, such as ceramics, plastics, and sheet metal, may also be used to form the heat sink 210, without deviation from the scope of the disclosure.

Although described herein with reference to the printhead 202, the printhead plate 206, and/or the printhead bracket 204 in rectangle shapes, the present disclosure contemplates that the printhead 202, the printhead plate 206, and/or the printhead bracket 204 may be of other shapes, such as a square shape, without deviation from the scope of the disclosure. Accordingly, there may be a variation in the count and positioning of the electronic components, such as the burn lines and connectors, in the printhead assembly 200. For example, in case the printhead 202, the printhead plate 206, and/or the printhead bracket 204 are square in shape with equal edges, there may be implemented at least four substrates (one substrate adjacent to an edge of the four edges), four burn lines (one burn line on one substrate adjacent to each edge) and four connectors (one connector corresponding to one edge) on each of the two surfaces of the printhead plate 206.

Figure 3A:
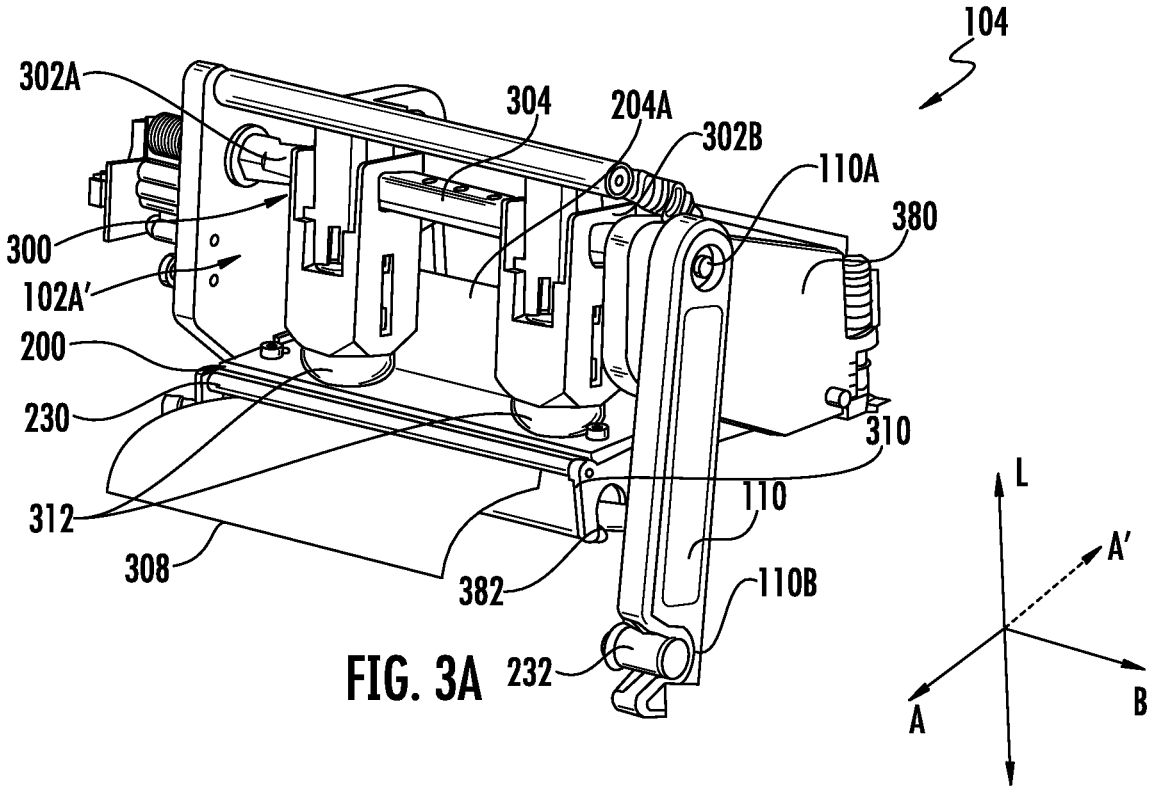
FIG. 3A illustrates an exploded perspective view of a printing assembly, in accordance with one or more embodiments of the present disclosure.
Figure 3B:
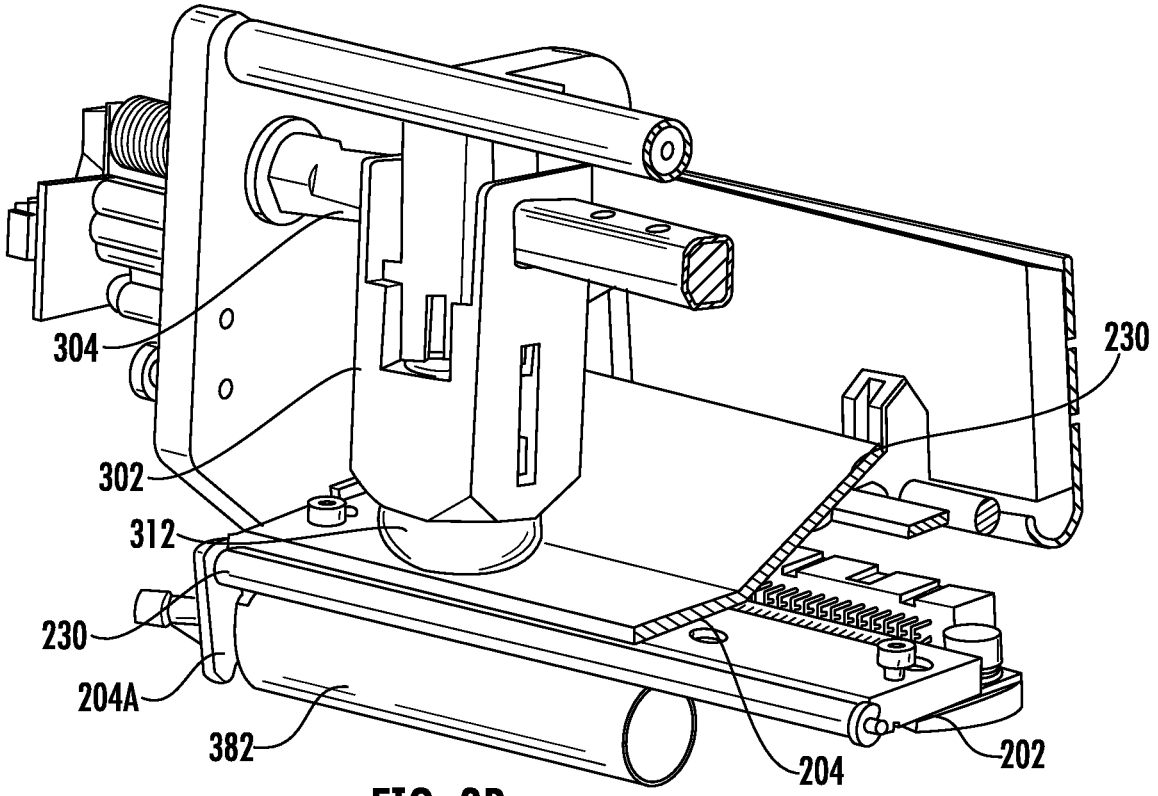
FIG. 3B illustrates an exploded cut-through perspective view of the printing assembly of FIG. 3A, in accordance with one or more embodiments of the present disclosure.

FIG. 3A illustrates a perspective view of the printing assembly 104 that includes the printhead pressure load assembly 300 engaged with the printhead assembly 200 enclosed in a rigid housing block 380, in accordance with one or more embodiments of the present disclosure. Further, FIG. 3B illustrates an exploded cut-through perspective view of the printing assembly 104 enclosed in the rigid housing block 380, in accordance with one or more embodiments of the present disclosure. Further, FIG. 3D illustrates a top view of the printhead pressure load assembly 300, in accordance with one or more embodiments of the present disclosure.

With reference to FIG. 3A, the printhead pressure load assembly 300 of the printing apparatus 100 may include a plurality of printhead pressure load modules 302, such as a first printhead pressure load module 302A and a second printhead pressure load module 302B, adjustable on a shaft 304 of the printhead pressure load assembly 300. The printhead pressure load assembly 300 is engaged with the printhead assembly 200, via pressure contact members 312 of the plurality of printhead pressure load modules 302. In various embodiments, the pressure contact members 312 may be made of, for example, but not limited to an acetal plastic material; a ceramic material; a porous, self-lubricating, bronze metal; aluminum metal; or stainless steel.

As the printhead assembly 200 is moved from loading position to printing position, the forks of the platen assembly (not shown) engage the tabs 204C of the printhead bracket 204 (shown in FIG. 4A) to adjust the location of the printhead assembly 200 relative to the platen roller 382 to achieve proper alignment for printing operation. The platen roller 382 in the platen assembly may be a motor generated driver that may drive the media forward/backward past the printhead assembly 200 and provide counter-pressure to the printhead assembly 200.

Structurally, the printhead pressure load assembly 300 may be held together, and thus engaged, with the printhead assembly 200 and other internal components of the printing apparatus 100 on a printer chassis 102A', which is a portion of the central support member 102A. The printer chassis 102A' is a structural member configured to hold and support a plurality of internal components in the casting 102 of the printing apparatus 100. The internal components may include the printhead assembly 200, the printhead pressure load assembly 300, and the support block assembly 106.

With reference to FIG. 3A, the printhead assembly 200 is extending a printhead width in a direction transverse to a web direction A of the print media 308. The web direction A corresponds to direction of exit of the print media 308 from the printing apparatus 100 after being printed by the printing apparatus 100. The shaft 304 extends in the cross web-direction B that is transverse to the web direction A of the print media 308. The shaft 304 is fixedly connected to the printhead pressure load assembly 300 at a height so that the pressure contact members 312 of the plurality of printhead pressure load modules 302 abuts the printhead assembly 200. One or more of the plurality of printhead pressure load modules 302 may be configured to individually and movably ride along the shaft 304 to engage with and exert pressure upon the printhead assembly 200 in the cross-web direction B. While the cross-sectional shape of the shaft 304 is a square with chamfered edges, as illustrated in FIG. 3B, the present disclosure contemplates that the cross-sectional shape of the shaft 304 may be rectangular or other such parallelogram, without deviating from the scope of the disclosure.

The printhead assembly 200 of the printing apparatus 100 is pivotally attached along an axis of the horizontally outward rod (not shown) mounted on the printer chassis 102A'. The printhead assembly 200 includes the printhead 202 which is mounted in the printhead assembly 200 with a retention mechanism as detailed in FIG. 2A. The printhead pressure load assembly 300 is pivotally attached to the printer chassis 102A' and is configured to be manually rotated, for example anticlockwise, via a printhead lever arm 110 along a rotational axis that is transverse to the web direction A. The rotation causes the printhead pressure load assembly 300 to be set in the loading position from the printing position. Further, the clockwise rotation of the printhead lever arm 110 along the rotational axis causes the printhead pressure load assembly 300 to be set in the printing position from the loading position. Consequently, the pressure contact members 312 of the plurality of printhead pressure load modules 302 engage with the printhead assembly 200 and the printing apparatus 100 is ready for the printing operation.

The pressure contact members 312 may include, for example an inverted dome-shaped profile or a cylindrical profile, configured to be slidably engaged with the surface of the printhead assembly 200. A plurality of detents within the printhead pressure load assembly 300 are configured to retain the printhead pressure load assembly 300 in either the loading position or the printing position. When the printhead pressure load assembly 300 is in the printing position, the plurality of printhead pressure load modules 302 maintain pressure on the printhead assembly 200 in the printing position with the printhead 202 engaged with the platen roller 382. In response to the printhead pressure load assembly 300 being moved from the printing position to the loading position, the plurality of printhead pressure load modules 302 are disengaged from the printhead assembly 200.

Each of the plurality of printhead pressure load modules 302 may be configured to vary the pressure exerted to the printhead assembly 200 through its corresponding pressure contact member 312. As the pressure between the printhead 202 and the platen roller 382 is crucial for controlling the print quality, it is important to maintain a suitable pressure across the printhead 202 as and when there is a change of the print media 308 that is being printed and/or a change in hardware characteristics of the printhead 202. For example, if the thickness of the print media 308 to be printed in current printing operation is less than the thickness of a print media printed in previous printing operation, the pressure between the printhead 202 and the platen roller 382 may be required to be increased. Additionally or alternatively, if the abrasion of the heating elements exceeds a threshold value or the heating elements are under-heated, the pressure between the printhead 202 and the platen roller 382 may be required to be increased.

Example embodiments may be configured to apply pressure to the printhead assembly 200, where the pressure load may vary between a minimum and a maximum level setting and where the pressure load may be adjusted to various levels within this range. Consequently, a suitable pressure load may be exerted by the plurality of printhead pressure load modules 302 at the printhead assembly 200, thereby depressing the printhead assembly 200 upon the print media 308 with a distributed pressure resulting in a uniform and high quality printing content on the print media 308. The print media 308, after being printed by the printhead assembly 200, traverses along the web direction A over the platen roller 382 and exits from the printing apparatus 100 through print media exit 310.

Figure 3C:
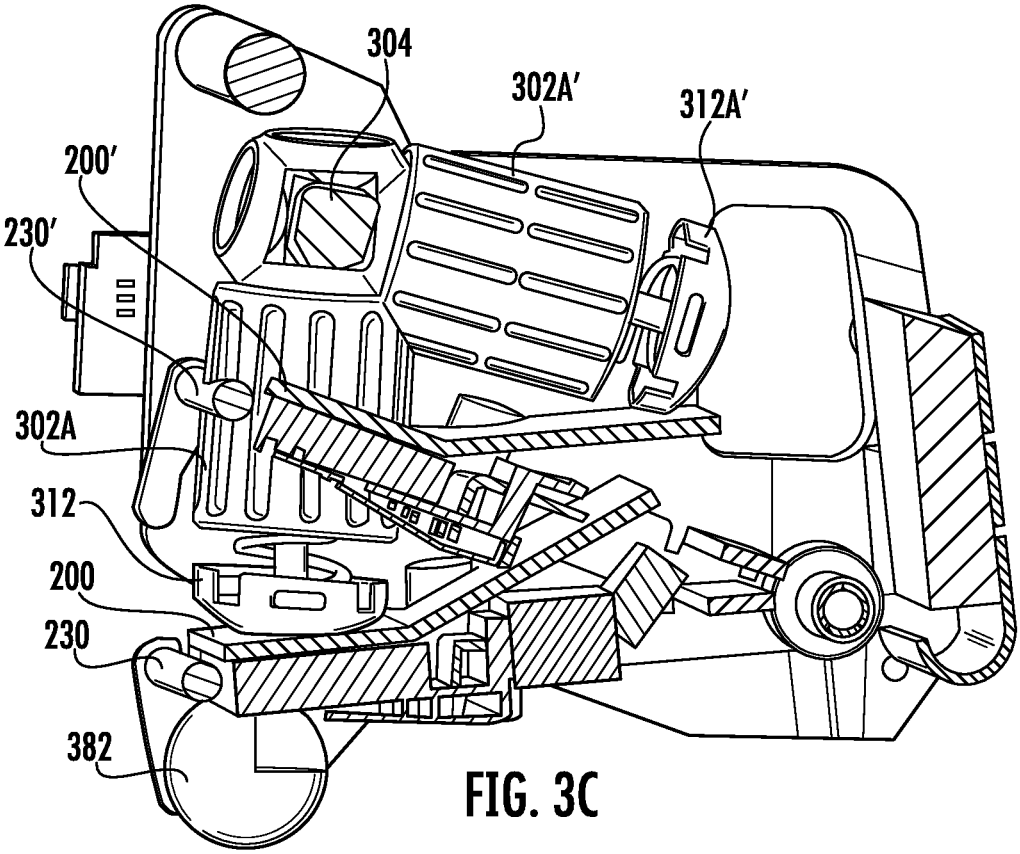
FIG. 3C illustrates a side view of the printing assembly of FIG. 3A, in accordance with one or more embodiments of the present disclosure.
Figure 3D:
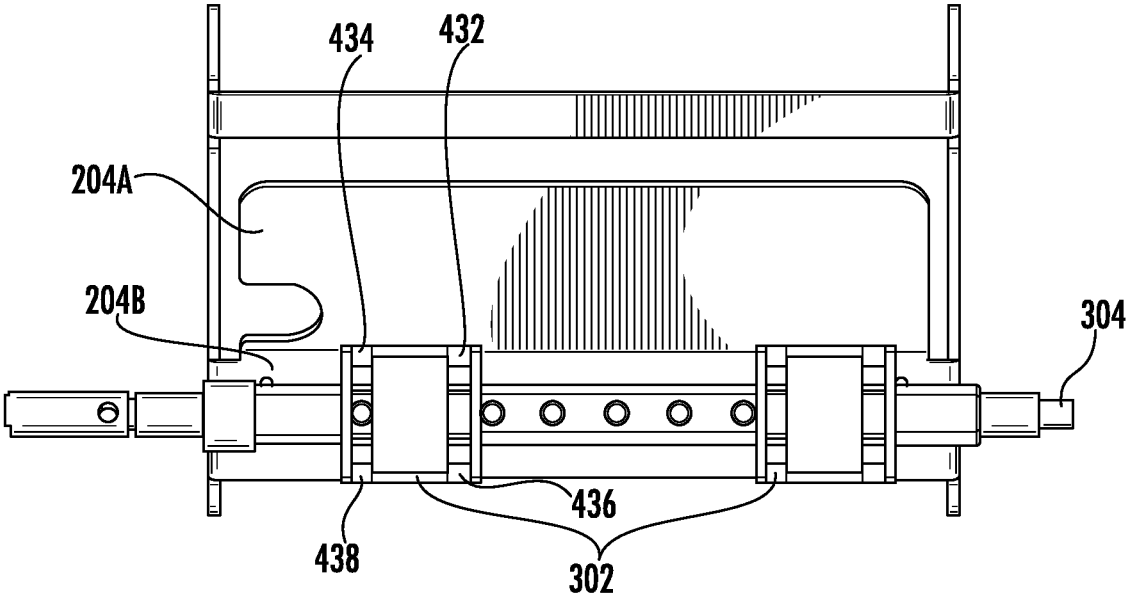
FIG. 3D illustrates a top view of the printhead pressure load assembly, in accordance with one or more embodiments of the present disclosure.

FIG. 3C illustrates a side view of the printing assembly 104, in accordance with one or more embodiments of the present disclosure. The printhead lever arm 110 may be configured to be adjusted in one of the loading position and the printing position based on an alignment of the plurality of printhead pressure load modules 302 with respect to the printhead assembly 200. While only the adjustment of the first printhead pressure load module 302A is illustrated in FIG. 3C, the present disclosure contemplates that the second printhead pressure load module 302B undergoes same adjustment in parallel to the adjustment of the first printhead pressure load module 302A, that has not been described herein for brevity.

With reference to FIG. 3C, a first alignment of the first printhead pressure load module 302A, a printhead support member 230, and the printhead assembly 200 is shown, when the printhead lever arm 110 is pivotally rotated clockwise around the pivot member 110A in the web direction A and the end portion 110B of the printhead lever arm 110 is locked at the locking member 232 provided at the support block assembly 106, as shown in FIG. 3A. In such alignment, the first printhead pressure load module 302A is engaged with the horizontal surface 204B of the printhead bracket 204 so that the printhead assembly 200 is operable to perform the printing operation.

There is further shown a second alignment of the first printhead pressure load module 302A', the printhead support member 230', and the printhead assembly 200', when the end portion 110B of the printhead lever arm 110 is unlocked from the locking member 232 and the printhead lever arm 110 is pivotally rotated anticlockwise around the pivot member 110A in the reverse web direction A'. The printhead lever arm 110 is adjusted in the loading position and the rigid housing block 380 can be lifted in the upward direction. The lifting operation of the rigid housing block 380 in the upward direction causes a slidable movement of the first printhead pressure load module 302A so that the first printhead pressure load module 302A is engaged with the inclined surface 204A and disengaged from the horizontal surface 204B of the printhead bracket 204. Consequently, the first printhead pressure load module 302A is adjusted in the second alignment. This is in contrast with the first alignment that is obtained when the rigid housing block 380 is pressed in the downward direction. Such operation on the rigid housing block 380 in the downward direction causes a slidable movement of the first printhead pressure load module 302A so that the first printhead pressure load module 302A is disengaged from the inclined surface 204A and engaged with the horizontal surface 204B of the printhead bracket 204. Consequently, the first printhead pressure load module 302A is adjusted in the first alignment.

In the second alignment, the printhead assembly 200 is also caused to become pivotable about a rod (not shown) and released from the support block assembly 106. By way of example, the printhead assembly 200 is pivoted away from its normal or ready position, so that the replacement of the ink ribbon or other maintenance operations can be performed.

Figure 4A:
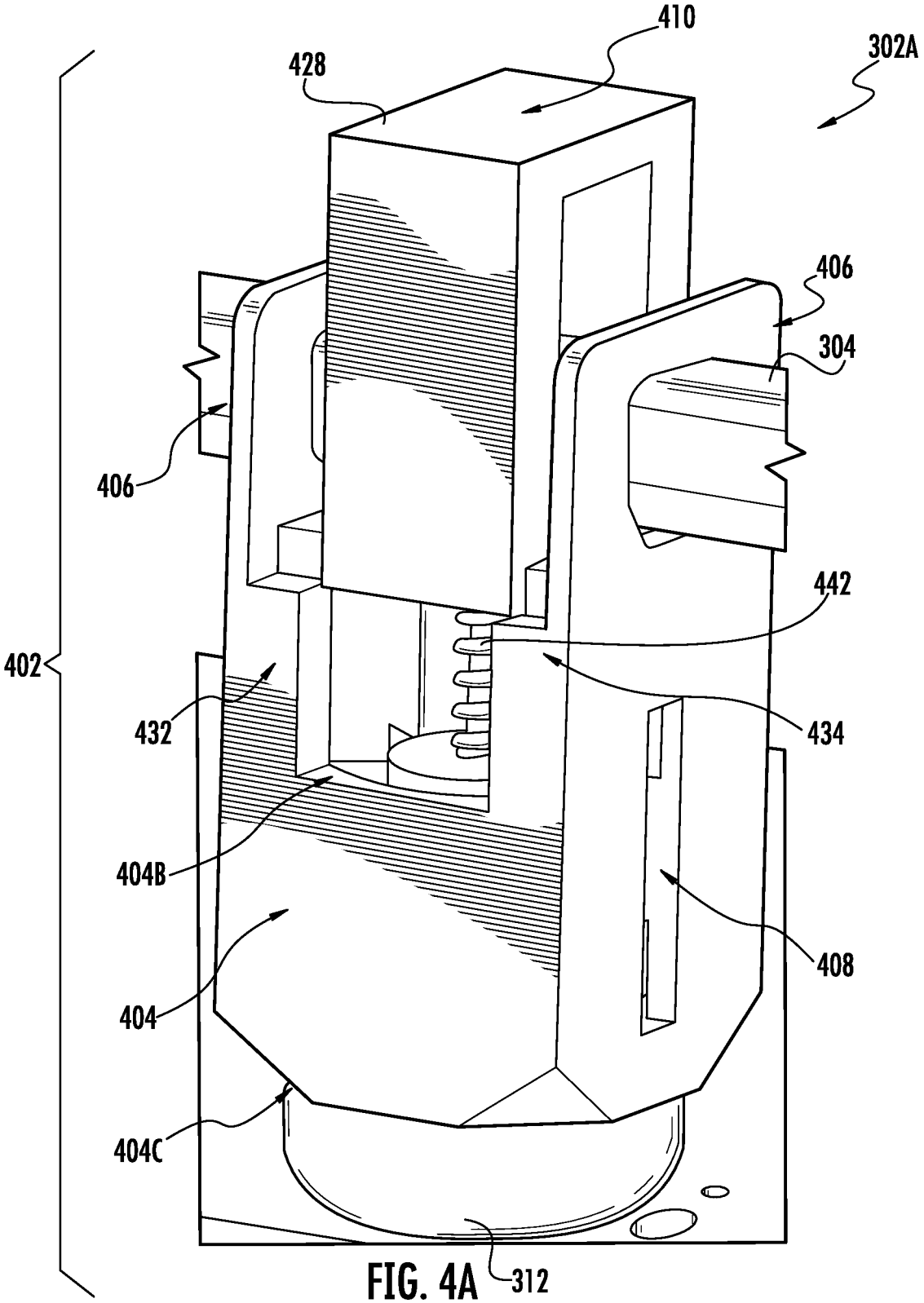
FIG. 4A illustrates a perspective view of a first printhead pressure load module, in accordance with one or more embodiments of the present disclosure.
Figure 4B:
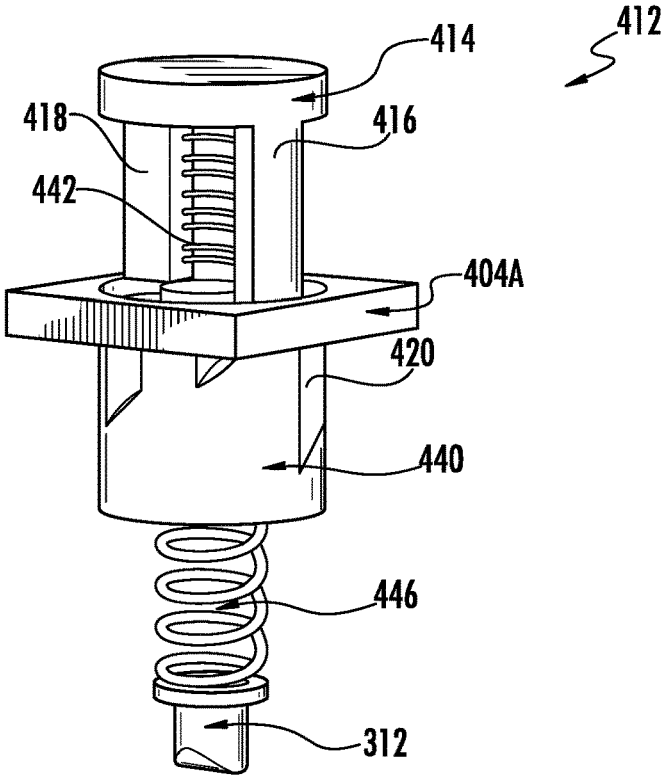
FIG. 4B illustrates longitudinal peripheral view of the first printhead pressure load module taken without the casting, in accordance with one or more embodiments of the present disclosure.
Figure 4C:
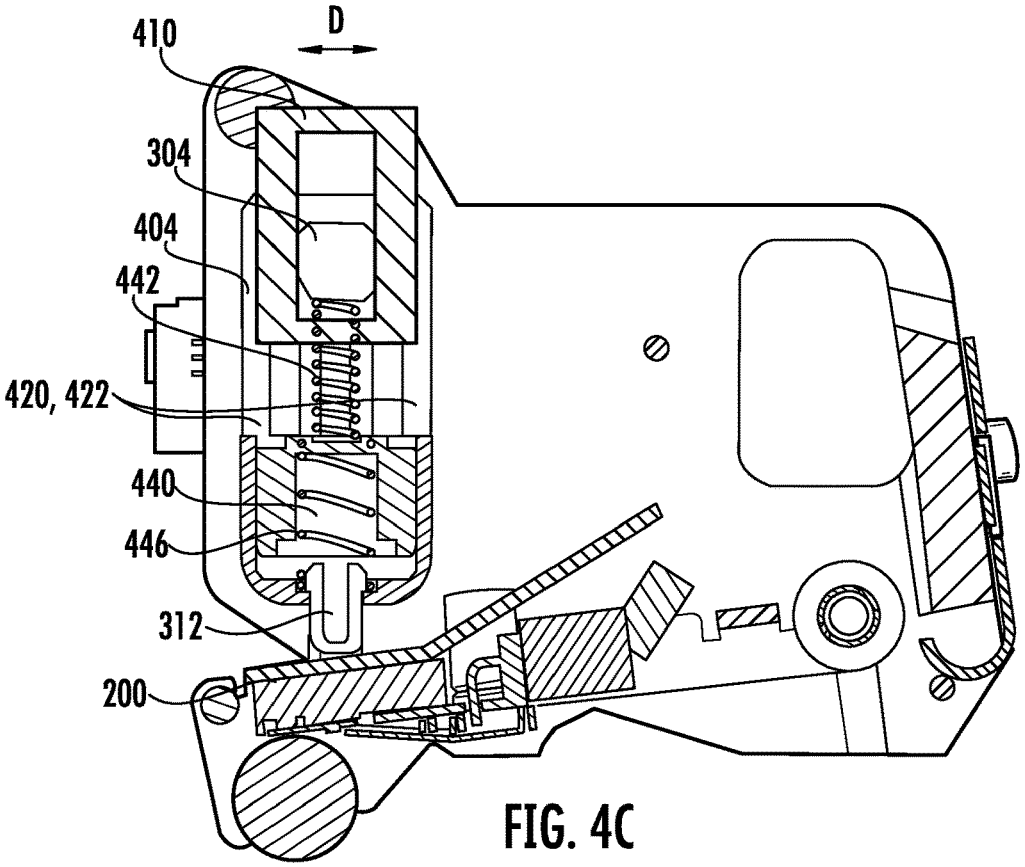
FIG. 4C illustrates a cut-through side view of the printing apparatus, in accordance with one or more embodiments of the present disclosure.
Figure 4D:
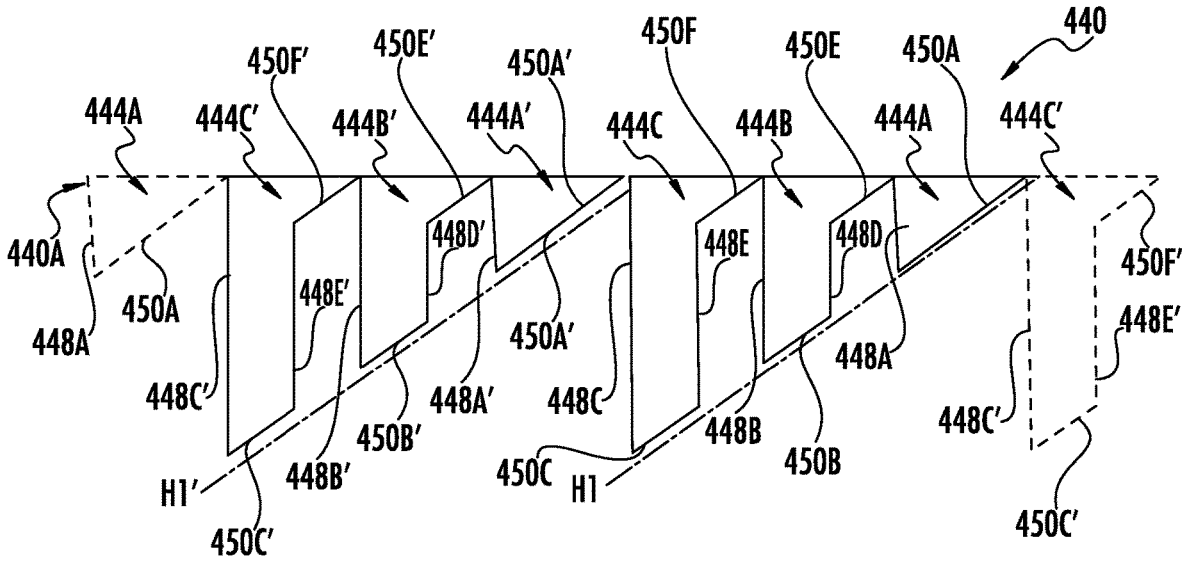
FIGS. 4D and 4E illustrates a rolled-out view and a top view, respectively, of a rotary cam, in accordance with one or more embodiments of the present disclosure.
Figure 4E:
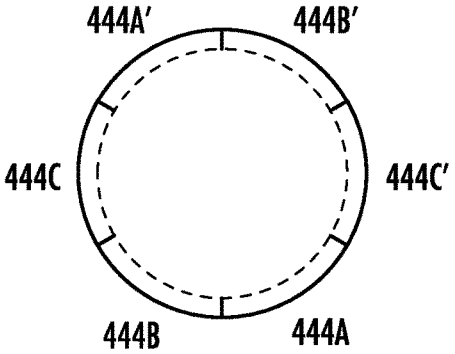

FIG. 4A illustrates a perspective view of the first printhead pressure load module 302A, in accordance with one or more embodiments of the present disclosure. FIG. 4B illustrates longitudinal peripheral view of the first printhead pressure load module 302A taken without the casting 102, thus showing the internal members in the first printhead pressure load module 302A, in accordance with one or more embodiments of the present disclosure. FIG. 4C illustrates cut-through side view of the printing apparatus 100, in accordance with one or more embodiments of the present disclosure. Further, FIGS. 4D and 4E illustrates a rolled-out view and a top view, respectively, of the rotary cam 440. While only the external and internal structure of the first printhead pressure load module 302A is illustrated in FIGS. 4A-4C, the present disclosure contemplates that the second printhead pressure load module 302B has the same external and internal structure, that has not been described herein for brevity.

The first printhead pressure load module 302A includes a module casing 402 having a hollow housing 404 with two wall structures 406. The two wall structures 406 may be a set of parallel wall members protruding through diametrically opposite longitudinal outer surfaces of the hollow housing 404. Each of the two wall structures 406 have a hole section in the top portion through which the first printhead pressure load module 302A is slidably secured along the shaft 304 that extends in the cross-web direction B. The hollow housing 404 of the module casing 402 has a longitudinal window member 408 that indicates current level of pressure load exerted by the first printhead pressure load module 302A on the printhead assembly 200.

The first printhead pressure load module 302A further includes a plunger body 410. The plunger body 410 further includes a plunger member 412 defined inside the plunger body 410, as illustrated in FIG. 4B. The plunger member 412 has a cap portion 414 and leg portions 416 and 418. The cap portion 414 and the leg portions 416 and 418 of the plunger member 412 are slidably engaged in and guided by the hollow housing 404. The cap portion 414 of the plunger member 412 is further extended horizontally to form a structure of a specified shape that is abutted and slidably guided by the inner surface of the hollow housing 404. The leg portions 416 and 418 are diametrically opposite to each other extending along the longitudinal axis L abutting the inner surface of the hollow housing 404. The leg portions 416 and 418 are slidably mounted through a top end 404B of the hollow housing 404. The leg portions 416 and 418 have a specified thickness, width, and length, and are extended from the bottom surface of the cap portion 414. Bottom end portions of the leg portions 416 and 418 are having chamfered surfaces with defined angular orientation, such as, but not limited to, 45 degrees.

The hollow housing 404 has a circumferentially structured stop member 404A with a cavity of a specified aperture configured to house fixed flanges 420 and 422 with a specified thickness, width, and length and defined on an inner surface of the hollow housing 404 as a protruding member transverse to the longitudinal axis L. The circumferentially structured stop member 404A acts as a stopping member for the plunger member 412 preventing it to move downward beyond the specified limit, and also for the rotary member 440 preventing it to move upward beyond the specified limit. Top portions of the fixed flanges 420 and 422 are extended from the circumferentially structured stop member 404A and defined on the inner surface of the hollow housing 404. Bottom end portions of the fixed flanges 420 and 422 are having chamfered surfaces with defined angular orientation which is similar to the defined angular orientation of the bottom end portions of the leg portions 416 and 418 (that are movably positioned adjacent to the fixed flanges 420 and 422).

Two opposite edges of the top portion of the circumferentially structured stop member 404A along the web direction A are further extended to define the two wall structures 406 along the longitudinal axis L. The separating distance D between the two wall structures 406 is substantially equal to the thickness of the shaft 304. The extent of movement of the plunger member 412 inwardly through the top end 404A of the hollow housing 404 is stopped by a limiting member 428 of the module casing 402 such that the stationary shaft 304 abuts the bottom surface of the of the limiting member 428 when the plunger member 412 is pressed inwardly to the full extent.

The first printhead pressure load module 302A further includes stopping members 430 and 432 extending from the top surface of the circumferentially structured stop member 404A along the cross-web direction B. The first printhead pressure load module 302A further includes stopping members 436 and 438 towards the opposite surface extending from the top surface of the circumferentially structured stop member 404A along the cross-web direction B.

The first printhead pressure load module 302A further includes a rotary cam 440 movably engaged in the hollow housing 404. The top portion of the rotary cam 440 is coupled with the bottom surface of the cap portion 414 of the plunger member 412 through a first biasing member 442. Thus, the top end of the first biasing member 442 is secured to the bottom surface of the cap portion 414 and the top surface of the rotary cam 440 is secured to the bottom end of the first biasing member 442. The first biasing member 442, upon compression due to the inwardly movement of the plunger member 412 through the top end 404A of the hollow housing 404, exerts a downward force on the rotary cam 440.

The rotary cam 440 further includes a plurality of channel members 444 defined at an outer surface of the rotary cam 440 and extending from the top surface 440A of the cap portion of the rotary cam 440 along the longitudinal axis L. Each channel member having a depth that is different from a depth of an adjacent channel member. The plurality of channel members 444 includes at least three pairs of channel members, 444A and 444A', 444B and 444B', and 444C and 444C'. Each pair of the at least three pairs of the plurality of channel members 444 have identical channel members, equidistant from an axis of rotation R of the rotary cam 440, and defined diametrically opposite to each other on the outer surface of the rotary cam 440. For example, first channel members, 444A and 444A' are identical channel members, equidistant from an axis of rotation R, and defined diametrically opposite to each other on the outer surface of the rotary cam 440. Similarly, second channel members, 444B and 444B' are identical channel members, equidistant from an axis of rotation R, and defined diametrically opposite to each other on the outer surface of the rotary cam 440. Similarly, third channel members, 444C and 444C' are identical channel members, equidistant from an axis of rotation R, and defined diametrically opposite to each other on the outer surface of the rotary cam 440. For example, first channel members 444A and 444A' have the same depth and first channel members 444A and 444A' have a different depth than the second and third channel members 444B, 444B', 444C, 444C'.

A periphery of each of the plurality of channel members 444 is defined by one or more longitudinal surfaces 448 and one or more chamfered surfaces 450. For example, as shown in FIG. 4E, a periphery of the first channel member 444A is defined by a first longitudinal surface 448A and a first chamfered surface 450A. Further, a periphery of the second channel member 444B is defined by two second longitudinal surfaces 448B and 448D and two second chamfered surfaces 450B and 450E. Further, a periphery of the third channel member 444C is defined by two third longitudinal surfaces 448C and 448E and two third chamfered surfaces 450C and 450F.

One of the one or more longitudinal surfaces in each channel member is a stopping longitudinal surface configured to stop a rotational movement of the rotary cam 440. For example, the longitudinal surfaces 448A, 448B, and 448C in the channel members 444A, 444B, and 444C respectively, are stopping longitudinal surfaces. The longitudinal surfaces 448D, 448D', 448E, and 448E' are referred to herein as secondary longitudinal surfaces, in contrast to the stopping longitudinal surfaces 448A, 448B, 448C, 448A', 448B', and 448C'.

At least one of the one or more chamfered surfaces in each channel member is defined along a helical path around the outer surface of the rotary cam 440 that defines a depth of the corresponding channel member. For example, the chamfered surfaces 450A, 450B, and 450C are defined along a helical path H1 (as illustrated in FIG. 4D) around the outer surface of the rotary cam 440. Similarly, the chamfered surfaces 450A', 450B', and 450C' (defined along the diametrically opposite side) are defined along a similar other helical path H1' (as illustrated in FIG. 4D) around the outer surface of the rotary cam 440. Others of the one or more chamfered surfaces in each channel member extend from the top surface of the rotary cam 440 to other longitudinal surface of the corresponding channel member. For example, the second chamfered surface 450E in the second channel member 444B extends from the top surface 440A of the cap portion of the rotary cam 440 to the second longitudinal surface 448B' of the second channel member 444B. Similarly, the third chamfered surface 450F in the channel member 444C extends from the top surface 440A of the cap portion of the rotary cam 440 to the third longitudinal surface 448C' of the third channel member 444C. The chamfered surfaces defined along the helical paths H1 and H1' (450A, 450B, 450C, 450A', 450B', and 450C') are referred to herein as the lower chamfered surfaces or the helical path defined chamfered surfaces, interchangeably. The remaining chamfered surfaces (450E, 450F, 450E', and 450F') are referred to herein as the upper chamfered surfaces.

The periphery defines two portions in a channel member. First portion acts as a stopping portion that stops/locks the rotation of the rotary cam 440 and defines the depth of the corresponding channel member. The first portion of a channel member 444 includes the longitudinal surface that acts as a stopping longitudinal surface for that channel member, the chamfered surface that is defined along the helical path, and, for the second and third channel members 444B, 444B', 444C, 444C', the other longitudinal surface. For example, as illustrated in FIG. 4D the stopping longitudinal surfaces are longitudinal surfaces 448A, 448B, 448C, 4448A', 448B', and 448C'. The helical path defined chamfered surfaces are chamfered surfaces 450A, 450B, 450C, 450A', 450B', and 450C'.

The second portion of the channel member 444 is a triangular portion that acts as a temporary resting portion for the leg portions 416 and 418, and the fixed flanges 420 and 422, and is defined adjacent to the first portion. The second portion includes the other chamfered surface that extends from the top surface 440A of the rotary cam 440 to the other longitudinal surface of the corresponding channel member. For example, the second portion is defined in part by chamfered surfaces 450E, 450F, 450E', and 450F'.

At least three pairs of the plurality of channel members 444 are engaged successively by the fixed flanges 420 and 422 that define the position of the rotary cam 440 along the longitudinal axis L with respect to the top end 404A of the hollow housing 404. For example, initially, the first channel member 444A is engaged by the fixed flange 420 and the first channel member 444A' is engaged by the fixed flange 422 that defines the position of the rotary cam 440 along the longitudinal axis L with respect to the top end 404A of the hollow housing 404 as P1. Successively, after and/or in responsive to the pressing and releasing of the plunger member 412, the second channel member 444B is engaged by the fixed flange 420 and the second channel member 44B' is engaged by the fixed flange 422 that defines the position of the rotary cam 440 along the longitudinal axis L with respect to the top end 404A of the hollow housing 404 as P2. Successively, after and/or in responsive to the pressing and releasing of the plunger member 412, the third channel member 444C is engaged by the fixed flange 420 and the third channel member 444C' is engaged by the fixed flange 422 that defines the position of the rotary cam 440 along the longitudinal axis L with respect to the top end 404A of the hollow housing 404 as P3. Successively, after and/or in responsive to the pressing and releasing of the plunger member 412, the first channel member 444A is engaged by the fixed flange 422 and the first channel member 444A' is engaged by the fixed flange 420 that defines the position of the rotary cam 440 along the longitudinal axis L with respect to the top end 404A of the hollow housing 404 back as P1.

The position of the rotary cam 440 along the longitudinal axis L defines a magnitude of the force F that acts on the pressure contact members 312 through a second biasing member 446. Opposite ends of the second biasing member 446 are secured to the bottom surface of the cap portion of the rotary cam 440 and a top surface of one of the pressure contact members 312, respectively, towards the bottom end 404C of the hollow housing 404. In an embodiment, the rotary cam 440 is designed to be in a hollow cylindrical structure closed at the top end and opened at the bottom end, as illustrated in FIG. 4C. The top end defines the cap portion of the rotary cam 440. For example, position P1 of the rotary cam 440 along the longitudinal axis L defines a magnitude of the force F1 that acts on the pressure contact members 312 through a second biasing member 446. This force F1 is the maximum force that acts on the pressure contact members 312 through the second biasing member 446. Next, position P2 of the rotary cam 440 along the longitudinal axis L defines a magnitude of the force F2 that acts on the pressure contact members 312 through the second biasing member 446. This force F2 is the intermediate force that acts on the pressure contact members 312 through the second biasing member 446. Next, position P3 of the rotary cam 440 along the longitudinal axis L defines a magnitude of the force F3 that acts on the pressure contact members 312 through the second biasing member 446. This force F3 is the minimum force that acts on the pressure contact members 312 through the second biasing member 446.

The longitudinal surfaces that acts as stopping surfaces are defined by an upper edge of a chamfered surface of an axially backward channel member (the channel member that is adjacent to the corresponding channel member in the direction of rotation of the rotary cam 440) of an and a lower edge of a chamfered surface of the corresponding channel member. For example, the stopping longitudinal surface 448A of the first channel member 444A is defined by an upper edge of the upper chamfered surface 450E of the second channel member 444B (that is axially backward to the channel member 444A) and a lower edge of the chamfered surface 450A of the channel member 444A. Similarly, the stopping longitudinal surface 448B of the second channel member 444B is defined by an upper edge of the upper chamfered surface 450F of the third channel member 444C (that is axially backward to the channel member 444B) and a lower edge of the chamfered surface 450B of the channel member 444B. Similarly, the stopping longitudinal surface 448C of the third channel member 444C is defined by an upper edge of the upper chamfered surface 450A' of the first channel member 444A' (that is axially backward to the channel member 444C) and a lower edge of the chamfered surface 450C of the third channel member 444C. Longitudinal surfaces 448A', 448B', and 448C' of channel members 444A', 444B', and 444C', which are positioned on diametrically opposite sides of the channel members 444A, 444B, and 444C, are defined in the similar manner, as explained above.

The secondary longitudinal surface of a channel member is defined by an upper edge of a lower chamfered surface of a channel member and a lower edge of an upper chamfered surface of the channel member. For example, the secondary longitudinal surface 448D of the second channel member 444B is defined by a lower edge of the upper chamfered surface 450E of the second channel member 444B and an upper edge of the lower chamfered surface 450B of the second channel member 444B. Similarly, the secondary longitudinal surface 448E of the third channel member 444C is defined by a lower edge of the upper chamfered surface 450F of the third channel member 444C and an upper edge of the lower chamfered surface 450C of the third channel member 444C. Secondary longitudinal surfaces 448D' and 448E' of channel members 444B' and 444C', which are positioned on diametrically opposite sides of the channel members 444B and 444C, are defined in the similar manner, as explained above.

In an instance when both the leg portions 416 and 418 and the fixed flanges 420 and 422 are engaged in the channel member, the longitudinal surface of the channel member is a stopping surface abutting the leg portions 416 and 418. For example, when the leg portion 416 and the fixed flange 420 are engaged in the first channel member 444A, the longitudinal surface 448A of the first channel member 444A is the stopping surface abutting the leg portion 416. At the same time, towards the diametrically opposite side of the rotary cam 440, the leg portion 418 and the fixed flange 422 are engaged in the first channel member 444A', the longitudinal surface 448A' of the first channel member 444A' is the stopping surface abutting the leg portion 418. Alternatively, when the leg portion 416 and the fixed flange 420 are engaged in the second channel member 444B, the longitudinal surface 448B of the channel member 444B is the stopping surface abutting the leg portion 416. At the same time, towards the diametrically opposite side of the rotary cam 440, the leg portion 418 and the fixed flange 422 are engaged in the second channel member 444B', the longitudinal surface 448B' of the second channel member 444B' is the stopping surface abutting the leg portion 418. Alternatively, when the leg portion 416 and the fixed flange 420 are engaged in the third channel member 444C, the longitudinal surface 448C of the third channel member 444C is the stopping surface abutting the leg portion 416. At the same time, towards the diametrically opposite side of the rotary cam 440, the leg portion 418 and the fixed flange 422 are engaged in the third channel member 444C', the longitudinal surface 448C' of the third channel member 444C' is the stopping surface abutting the leg portion 418.

In another instance, when the leg portions 416 and 418 are withdrawn due to movement of the plunger member 412 outwardly under the influence of the first biasing member 442, the longitudinal surface of the channel member acts as a stopping surface abutting the fixed flanges 420 and 422. For example, when the leg portion 416 is withdrawn due to movement of the plunger member 412 outwardly under the influence of the first biasing member 442, the longitudinal surface 448A of the first channel member 444A acts as a stopping surface abutting the fixed flange 420. At the same time, the longitudinal surface 448A' of the first channel member 444A' acts as a stopping surface abutting the fixed flange 420. Alternatively, when the leg portion 416 is withdrawn due to movement of the plunger member 412 outwardly under the influence of the first biasing member 442, the longitudinal surface 448B of the second channel member 444B acts as a stopping surface abutting the fixed flange 420. At the same time, the longitudinal surface 448B' of the second channel member 444B' acts as a stopping surface abutting the fixed flange 422. Alternatively, when the leg portion 416 is withdrawn due to movement of the plunger member 412 outwardly under the influence of the first biasing member 442, the longitudinal surface 448C of the third channel member 444C acts as a stopping surface abutting the fixed flange 420. At the same time, the longitudinal surface 448C' of the third channel member 444C' acts as a stopping surface abutting the fixed flange 422.

FIG. 4E illustrates a top view of the rotary cam 440 that includes at least three pairs of channel members, i.e. 444A and 444A', 444B and 444B', and 444C and 444AC'. Each pair of the at least three pairs of channel members have identical channel members, i.e. periphery of first channel member 444A is identical to the periphery of first channel member 444A', periphery of second channel member 444B is identical to the periphery of second channel member 444B', and periphery of third channel member 444C is identical to the periphery of third channel member 444AC'. Further, the three pairs of channel members, i.e. 444A and 444A', 444B and 444B', and 444C and 444AC' are equidistant from an axis of rotation of the rotary cam 440. As illustrated in FIG. 4E, channel members 444A and 444A' of a first pair of channel members are defined diametrically opposite to each other, channel members 444B and 444B' of a second pair of channel members are defined diametrically opposite to each other, and channel members 444C and 444AC' of a third pair of channel members are defined diametrically opposite to each other on the outer surface of the rotary cam 440.

FIGS. 5A-5F illustrate an operational sequence of the longitudinal peripheral view of the first printhead pressure load module 302A taken without the casting 102 (as illustrated in FIG. 4B), in accordance with one or more embodiments of the present disclosure. The operational sequence, as illustrated in FIGS. 5A-5E, corresponds to translation of the first printhead pressure load module 302A from minimum pressure load setting to maximum pressure load setting. FIGS. 5A-5F are described in conjunction with FIGS. 4A-4E. While only one of the plurality of printhead pressure load modules 302, i.e. the first printhead pressure load module 302A, is illustrated to describe the operational sequence that corresponds to translation of the first printhead pressure load module 302A from minimum pressure load setting to maximum pressure load setting, the present disclosure contemplates that the second printhead pressure load module 302B has the same operational sequence simultaneously, that has not been described herein for brevity. FIGS. 5G and 5H illustrate first position (minimum pressure load setting) and second position (maximum pressure load setting) of rotary cam, in accordance with FIGS. 5A-5F, as shown through a longitudinal window of hollow housing of the rotary cam, in accordance with one or more embodiments of the present disclosure.

Figure 5A:
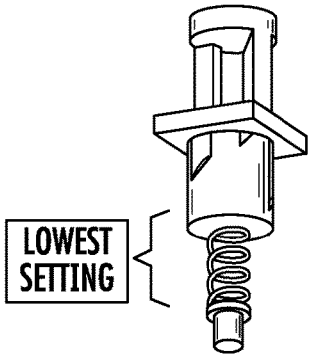
FIGS. 5A-5F illustrate an operational sequence of the longitudinal peripheral view of the first printhead pressure load module taken without the casting (as illustrated in FIG. 4B), in accordance with one or more embodiments of the present disclosure.

In operation, as illustrated in FIG. 5A, the printing apparatus 100 is in printing mode, and thus the first printhead pressure load module 302A is in vertically upright alignment engaged with a horizontal surface 204B of the printhead bracket 204. The leg portions 416 and 418 rest in the second portions of the first channel member 444A and 444A', movably positioned adjacent to the fixed flanges 420 and 422, which are locked in the first portions of the third channel members 444C and 444C. Such a state of various components of the first printhead pressure load module 302A defines a first position of the rotary cam 440 along the longitudinal axis with respect to the top end 404A of the hollow housing 404. Such a position of the rotary cam 440 indicates a minimum pressure setting that defines a minimum/no force that can act on the pressure contact member 312 through the second biasing member 446, as the second biasing member 446 is not compressed at all. The first position is shown through the longitudinal window 408 of the hollow housing 404 of the rotary cam 440 as illustrated in FIG. 5G. For example, in FIG. 5A, the printhead pressure load module 302A is in position P3 and exerting force F3 on the horizontal surface 204B of the printhead bracket 204.

Figure 5B:
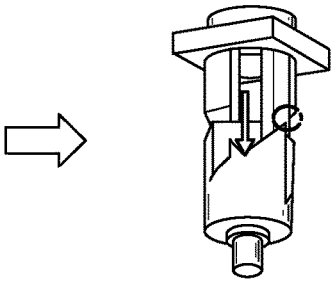

FIG. 5B illustrates the next step of the operation sequence. The plunger member 412 is moved inwardly through the top end 404A of the hollow housing 404 and causes a downward movement of the leg portions 416 and 418, along the longitudinal axis L, with respect to the fixed flanges 420 and 422. In some embodiments, the inward movement of the plunger member 412 is caused by an external force applied by an operator of the printing apparatus 100. In other embodiments, the inward movement of the plunger member 412 is caused by an external force actuated by the control unit of the printing apparatus 100. The inward movement of the plunger member 412 may be in response to a change in type of print media or a print feedback provided by a verifier unit to the control unit.

The inward movement of the plunger member 412 defines a force that is exerted on the chamfered surfaces, for example 450A and 450A', of the first channel members 444A and 444A' respectively. Such force imparts an axially downward movement to the rotary cam 440 until the fixed flanges 420 and 422, abutting the stopping longitudinal surfaces 448C and 448C' of the third pair of channel members 444C and 444C', are disengaged from the third pair of channel members 444C and 444C'. As the lower edges of the chamfered surfaces of the fixed flanges 420 and 422 reach the points of contact with the upper edges of the chamfered surfaces 450A and 450A', the fixed flanges 420 and 422 are disengaged from the third pair of channel members 444C and 444C'. Due to the inward movement of the plunger member 412 and the axially downward movement of the rotary cam 440, the first biasing member 442 and the second biasing member 446 are also compressed. Resultantly, an upward force is exerted at rotary cam 440 by the second biasing member 446. Also, an upward force is exerted at the plunger member 412 by the first biasing member 442 but is countered by the continued external force applied on the plunger member 412.

Figure 5C:
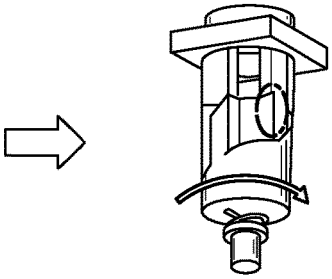

FIG. 5C illustrates the next step of the operation sequence. The disengagement of the fixed flanges 420 and 422 from the stopping longitudinal surfaces 448C and 448C' of the third pair of channel members 444C and 444C' and the upward force exerted by the rotary cam 440 under the influence of the second biasing member 446 causes a slidable movement of the chamfered surfaces of the leg portions 416 and 418 and the fixed flanges 420 and 422 along the chamfered surfaces 450A and 450A' of the first pair of channel members 444A and 444A'. The slidable movement is continued until the leg portions 416 and 418 abut the stopping longitudinal surfaces 448A and 448A' of the first pair of channel members 444A and 444A' and the leg portions 416 and 418 with adjacent fixed flanges 420 and 422 are engaged in the first pair of channel members 444A and 444A'. Such slidable movement causes a first unidirectional axial rotational movement, clockwise in this case, of the rotary cam 440 in unison with an upward movement of the rotary cam 440 until the leg portions 416 and 418 abut the stopping longitudinal surfaces 448A and 448A' of the first pair of channel members 444A and 444A', and the fixed flanges 420 and 422, adjacent to the leg portions 416 and 418, are engaged in the first pair of channel members 444A and 444A'.

Figure 5D:
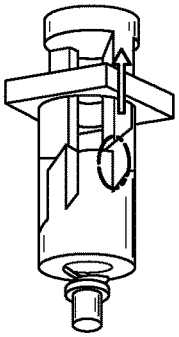

FIG. 5D illustrates the next step of the operation sequence. The external force that was applied on the plunger member 412 is removed. Consequently, under the influence of the upward force exerted at the plunger member 412 by the first biasing member 442, the plunger member 412 is forcibly allowed to move outwardly that causes the leg portions 416 and 418 to withdraw from the first portions of the first pair of channel members 444A and 444A'. The withdrawal of the leg portions 416 and 418 from the first pair of channel members 444A and 444A' results in disengagement of the leg portions 416 and 418 from the stopping longitudinal surfaces 448A and 448A' of the first pair of channel members 444A and 444A'. As the lower edge of the chamfered surfaces of the leg portions 416 and 418 reach the points of contact with the upper edge of the chamfered surfaces 450E and 450E', the first pair of channel members 444A and 444A' disengages the leg portions 416 and 418.

Figure 5E:
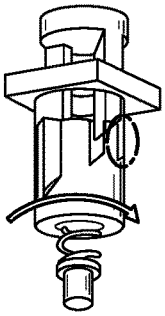

FIG. 5E illustrates the next step of the operation sequence. The disengagement of the leg portions 416 and 418 from the stopping longitudinal surfaces 448A and 448A' of the first pair of channel members 444A and 444A' and the upward force exerted at the rotary cam 440 by the second biasing member 446 causes a slidable movement of the chamfered surfaces of the leg portions 416 and 418 along the chamfered surfaces 450E and 450E' of the second pair of channel members 444B and 444B', and the chamfered surfaces of the fixed flanges 420 and 422 along the chamfered surfaces 450A and 450A' of the first pair of channel members 444A and 444A'. The slidable movement is continued until the fixed flanges 420 and 422 abut the stopping longitudinal surfaces 448A and 448A' of the first pair of channel members 444A and 444A'. Such slidable movement causes a second unidirectional axial rotational movement, clockwise in this case, of the rotary cam 440 in unison with an upward movement of the rotary cam 440 until the fixed flanges 420 and 422 abut the stopping longitudinal surfaces 448A and 448A' of the first pair of channel members 444A and 444A'.

Figure 5F:
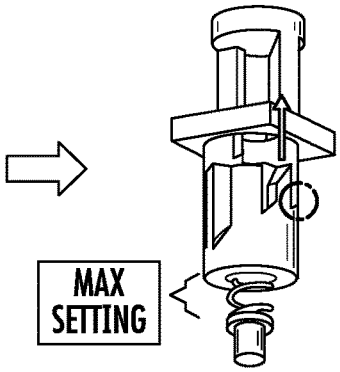
Figure 5G:
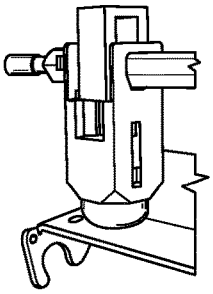
FIGS. 5G and 5H illustrate first position (at minimum pressure load setting) and second position (at maximum pressure load setting) of the rotary cam, in accordance with FIGS. 5A-5F, as shown through a longitudinal window of hollow housing of the rotary cam, in accordance with one or more embodiments of the present disclosure.
Figure 5H:
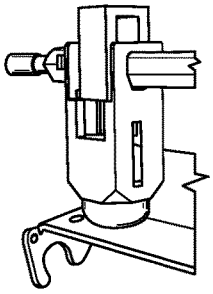

FIG. 5F illustrates the last step of the operation sequence. Under the influence of the upward force exerted at the plunger member 412 by the first biasing member 442, and removal of the external force that was applied on the plunger member 412, the plunger member 412 is forcibly allowed to further move outwardly that causes the leg portions 416 and 418 to disengage from the rotary cam 440 until the outward movement of the top surface of the cap portion 414 is stopped by the bottom surface of the shaft 304. Such a state of various components of the first printhead pressure load module 302A defines a first position P1 of the rotary cam 440 along the longitudinal axis with respect to the top end 404A of the hollow housing 404. Such a position of the rotary cam 440 indicates a maximum pressure setting that defines a maximum/full force F1 that can act on the pressure contact member 312 through the second biasing member 446, as the second biasing member 446 in compressed to the maximum extent. The first position P1 is shown through the longitudinal window 408 of the hollow housing 404 of the rotary cam 440 as illustrated in FIG. 5H. For example, FIG. 5F illustrates the printhead pressure load module 302A in the first position P1 and applying the maximum force F1 to the on the horizontal surface 204B of the printhead bracket 204.

Figure 6A:
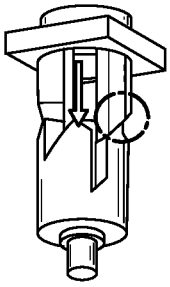
FIGS. 6A-6F illustrate another operational sequence of the longitudinal peripheral view of the first printhead pressure load module taken without the casting (as illustrated in FIG. 4B), in accordance with one or more embodiments of the present disclosure.
Figure 6B:
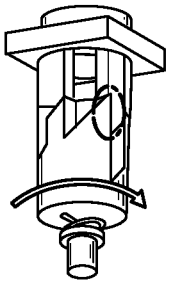
Figure 6C:
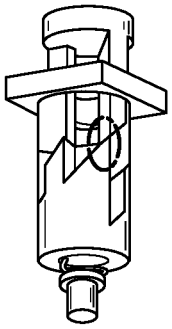
Figure 6D:
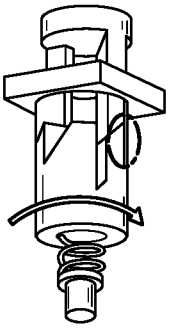
Figure 6E:
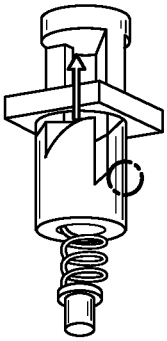
Figure 6F:
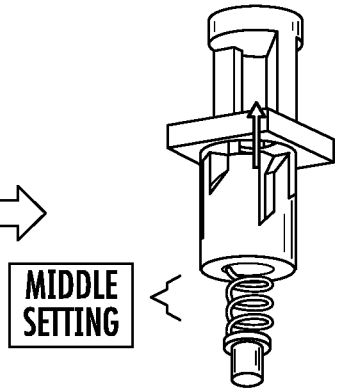
Figure 6G:
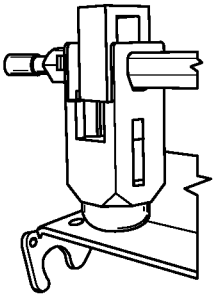
FIGS. 6G and 6H illustrate second position (at maximum pressure load setting) and third position (at intermediate pressure load setting) of rotary cam, in accordance with FIGS. 6A-6F, as shown through a longitudinal window of hollow housing of the rotary cam, in accordance with one or more embodiments of the present disclosure.
Figure 6H:
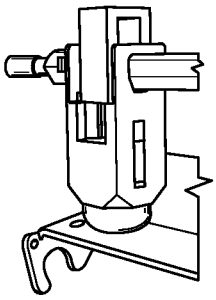

FIGS. 6A-6F illustrate another operational sequence of the longitudinal peripheral view of the first printhead pressure load module 302A taken without the casting 102 (as illustrated in FIG. 4B), in accordance with one or more embodiments of the present disclosure. The operational sequence, as illustrated in FIGS. 6A-6E, corresponds to translation of the first printhead pressure load module 302A from maximum pressure load setting (position P1) to intermediate pressure load setting (position P2). FIGS. 6A-6F are described in conjunction with FIGS. 4A-4E. While only one of the plurality of printhead pressure load modules 302, i.e. the first printhead pressure load module 302A, is illustrated to describe the operational sequence that corresponds to translation of the first printhead pressure load module 302A from maximum pressure load setting to intermediate pressure load setting, the present disclosure contemplates that the second printhead pressure load module 302B has the same operational sequence simultaneously, that has not been described herein for brevity. FIGS. 6G and 6H illustrate second position (maximum pressure load setting) and third position (intermediate pressure load setting) of rotary cam, in accordance with FIGS. 6A-6F, as shown through a longitudinal window of hollow housing of the rotary cam, in accordance with one or more embodiments of the present disclosure. For example, FIG. 6F illustrates the printhead pressure load module 302A in the second position P2 and applying the intermediate force F2 to the on the horizontal surface 204B of the printhead bracket 204.

In operation, as illustrated in FIG. 6A, the printing apparatus 100 is in printing mode, and thus the first printhead pressure load module 302A is in vertically upright alignment engaged with the horizontal surface 204B of the printhead bracket 204. The fixed flanges 420 and 422' are locked in the first portions of the channel members 444A and 444A'. Such a state of various components of the first printhead pressure load module 302A defines the second position of the rotary cam 440 along the longitudinal axis with respect to the top end 404A of the hollow housing 404. Such a position of the rotary cam 440 indicates a maximum pressure setting that defines a maximum/full force that can act on the pressure contact member 312 through the second biasing member 446, as the second biasing member 446 is fully compressed. The second position is shown through the longitudinal window 408 of the hollow housing 404 of the rotary cam 440 as illustrated in FIG. 6G.

The plunger member 412 is moved inwardly through the top end 404A of the hollow housing 404 and causes a downward movement of the leg portions 416 and 418, along the longitudinal axis L, with respect to the fixed flanges 420 and 422. In some embodiments, the inward movement of the plunger member 412 is caused by an external force applied by an operator of the printing apparatus 100. In other embodiments, the inward movement of the plunger member 412 is caused by an external force actuated by the control unit of the printing apparatus 100. The inward movement of the plunger member 412 may be in response to a change in type of print media or a print feedback provided by a verifier unit to the control unit.

The inward movement of the plunger member 412 defines a force that is exerted on the chamfered surfaces, for example 450E and 450E', of the channel members 444B and 444B' respectively. Such force imparts an axially downward movement to the rotary cam 440 until the fixed flanges 420 and 422, abutting the stopping longitudinal surfaces 448A and 448A' of the first pair of channel members 444A and 444A', are disengaged from the first pair of channel members 444A and 444A'. As the lower edges of the chamfered surfaces of the fixed flanges 420 and 422 reach the points of contact with the upper edges of the chamfered surfaces 450E and 450E', the first pair of channel members 444A and 444A' disengages from the fixed flanges 420 and 422. Due to the inward movement of the plunger member 412 and the axially downward movement of the rotary cam 440, the first biasing member 442 and the second biasing member 446 are also compressed. Resultantly, an upward force is exerted at rotary cam 440 by the second biasing member 446. Also, an upward force is exerted at the plunger member 412 by the first biasing member 442 but is countered by the continued external force applied on the plunger member 412.

FIG. 6B illustrates the next step of the operation sequence. The disengagement of the fixed flanges 420 and 422 from the stopping longitudinal surfaces 448A and 448A' of the first pair of channel members 444A and 444A' and the upward force exerted by the rotary cam 440 under the influence of the second biasing member 446 causes a slidable movement of the chamfered surfaces of the leg portions 416 and 418 and the fixed flanges 420 and 422 along the chamfered surfaces 450E and 450E' of the second pair of channel members 444B and 444B'. The slidable movement is continued until the leg portions 416 and 418 abut the stopping longitudinal surfaces 448B and 448B' of the second pair of channel members 444B and 444B' and the leg portions 416 and 418 with adjacent fixed flanges 420 and 422 are engaged in the second pair of channel members 444B and 444B'. Such slidable movement causes a first unidirectional axial rotational movement, clockwise in this case, of the rotary cam 440 in unison with an upward movement of the rotary cam 440 until the leg portions 416 and 418 abut the stopping longitudinal surfaces 448B and 448B' of the second pair of channel members 444B and 444B', and the fixed flanges 420 and 422, adjacent to the leg portions 416 and 418, are engaged in the second pair of channel members 444B and 444B'. Specifically, the leg portions 416 and 418 are engaged in the first portions of the second pair of channel members 444B and 444B' and the fixed flanges 420 and 422, adjacent to the leg portions 416 and 418, are engaged in the second portions of the second pair of channel members 444B and 444B'

FIG. 6C illustrates the next step of the operation sequence. The external force that was applied on the plunger member 412 is removed. Consequently, under the influence of the upward force exerted at the plunger member 412 by the first biasing member 442, the plunger member 412 is forcibly allowed to move outwardly that causes the leg portions 416 and 418 to withdraw from the first portions of the second pair of channel members 444B and 444B'. The withdrawal of the leg portions 416 and 418 from the second pair of channel members 444B and 444B' results in disengagement of the leg portions 416 and 418 from the stopping longitudinal surfaces 448B and 448B' of the second pair of channel members 444B and 444B'. As the lower edges of the chamfered surfaces of the leg portions 416 and 418 reach the points of contact with the upper edges of the chamfered surfaces 450F and 450F', the second pair of channel members 444B and 444B' disengages the leg portions 416 and 418.

FIG. 6D illustrates the next step of the operation sequence. The disengagement of the leg portions 416 and 418 from the stopping longitudinal surfaces 448B and 448B' of the second pair of channel members 444B and 444B' and the upward force exerted at the rotary cam 440 by the second biasing member 446 causes a slidable movement of the chamfered surfaces of the leg portions 416 and 418 along the chamfered surfaces 450F and 450F' of the third pair of channel members 444C and 444C', and the chamfered surfaces of the fixed flanges 420 and 422 along the chamfered surfaces 450F and 450F' of the third pair of channel members 444C and 444C'. The slidable movement is continued until the fixed flanges 420 and 422 abut the stopping longitudinal surfaces 448B and 448B' of the second pair of channel members 444B and 444B'. Such slidable movement causes a second unidirectional axial rotational movement, clockwise in this case, of the rotary cam 440 in unison with an upward movement of the rotary cam 440 until the fixed flanges 420 and 422 abut the stopping longitudinal surfaces 448B and 448B' of the second pair of channel members 444B and 444B'.

FIG. 6E illustrates the next step of the operation sequence. The upward movement of the rotary cam 440 under the influence of the second biasing member 446 completely engages the fixed flanges 420 and 422 in the first portions of the second pair of channel members 444B and 444B'.

FIG. 6F illustrates the last step of the operation sequence. Under the influence of the upward force exerted at the plunger member 412 by the first biasing member 442, and removal of the external force that was applied on the plunger member 412, the plunger member 412 is forcibly allowed to further move outwardly that causes the leg portions 416 and 418 to completely disengage from the rotary cam 440 until the outward movement of the top surface of the cap portion 414 is stopped by the bottom surface of the shaft 304. Such a state of various components of the first printhead pressure load module 302A defines a third position of the rotary cam 440 along the longitudinal axis with respect to the top end 404A of the hollow housing 404. Such a position of the rotary cam 440 indicates an intermediate pressure setting that defines an intermediate/partial force that can act on the pressure contact member 312 through the second biasing member 446, as the second biasing member 446 in partially compressed. The third position is shown through the longitudinal window 408 of the hollow housing 404 of the rotary cam 440 as illustrated in FIG. 6H.

FIGS. 7A-7F illustrate yet another operational sequence of the longitudinal peripheral view of the first printhead pressure load module 302A taken without the casting 102 (as illustrated in FIG. 4B) in an embodiment of the disclosure. The operational sequence, as illustrated in FIGS. 7A-7E, corresponds to translation of the first printhead pressure load module 302A from an intermediate pressure load setting to minimum pressure load setting. For example, FIGS. 7A-7F illustrate the transition of the printhead pressure load module 302A from the second position P2 to the third position P3. FIGS. 7A-7F are described in conjunction with FIGS. 4A-4E. While only one of the plurality of printhead pressure load modules 302, i.e. the first printhead pressure load module 302A, is illustrated to describe the operational sequence that corresponds to translation of the first printhead pressure load module 302A from maximum pressure load setting to intermediate pressure load setting, the present disclosure contemplates that the second printhead pressure load module 302B has the same operational sequence simultaneously, that has not been described herein for brevity. FIGS. 7G and 7H illustrate third position (intermediate pressure load setting) and first position (minimum pressure load setting) of rotary cam, in accordance with FIGS. 7A-7F, as shown through a longitudinal window of hollow housing of the rotary cam, in accordance with one or more embodiments of the present disclosure.

Figure 7A:
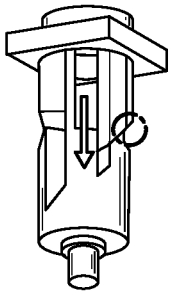
FIGS. 7A-7F illustrate yet another operational sequence of the longitudinal peripheral view of the first printhead pressure load module taken without the casting (as illustrated in FIG. 4B), in accordance with one or more embodiments of the present disclosure.

In operation, as illustrated in FIG. 7A, the printing apparatus 100 is in printing mode, and thus the first printhead pressure load module 302A is in vertically upright alignment engaged with the horizontal surface 204B of the printhead bracket 204. The fixed flanges 420 and 422' are locked in the first portions of the channel members 444B and 444B'. Such a state of various components of the first printhead pressure load module 302A defines the third position of the rotary cam 440 along the longitudinal axis with respect to the top end 404A of the hollow housing 404. Such a position of the rotary cam 440 indicates an intermediate pressure setting that defines an intermediate/partial force that can act on the pressure contact member 312 through the second biasing member 446, as the second biasing member 446 is partially compressed. The third position is shown through the longitudinal window 408 of the hollow housing 404 of the rotary cam 440 as illustrated in FIG. 7G.

The plunger member 412 is moved inwardly through the top end 404A of the hollow housing 404 and causes a downward movement of the leg portions 416 and 418, along the longitudinal axis L, with respect to the fixed flanges 420 and 422. In some embodiments, the inward movement of the plunger member 412 is caused by an external force applied by an operator of the printing apparatus 100. In other embodiments, the inward movement of the plunger member 412 is caused by an external force actuated by the control unit of the printing apparatus 100. The inward movement of the plunger member 412 may be in response to a change in type of print media or a print feedback provided by a verifier unit to the control unit.

The inward movement of the plunger member 412 defines a force that is exerted on the chamfered surfaces, for example 450F and 450F', of the channel members 444C and 444C' respectively. Such force imparts an axially downward movement to the rotary cam 440 until the fixed flanges 420 and 422, abutting the stopping longitudinal surfaces 448B and 448B' of the second pair of channel members 444B and 444B', are disengaged from the second pair of channel members 444B and 444B'. As the lower edges of the chamfered surfaces of the fixed flanges 420 and 422 reach the points of contact with the upper edges of the chamfered surfaces 450F and 450F', the second pair of channel members 444B and 444B' disengages from the fixed flanges 420 and 422. Due to the inward movement of the plunger member 412 and the axially downward movement of the rotary cam 440, the first biasing member 442 and the second biasing member 446 are also compressed. Resultantly, an upward force is exerted at rotary cam 440 by the second biasing member 446. Also, an upward force is exerted at the plunger member 412 by the first biasing member 442 but is countered by the continued external force applied on the plunger member 412.

Figure 7B:
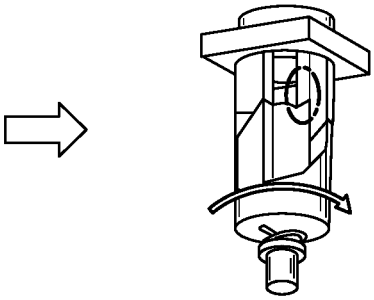

FIG. 7B illustrates the next step of the operation sequence. The disengagement of the fixed flanges 420 and 422 from the stopping longitudinal surfaces 448B and 448B' of the second pair of channel members 444B and 444B' and the upward force exerted by the rotary cam 440 under the influence of the second biasing member 446 causes a slidable movement of the chamfered surfaces of the leg portions 416 and 418 and the fixed flanges 420 and 422 along the chamfered surfaces 450F and 450F' of the third pair of channel members 444C and 444C'. The slidable movement is continued until the leg portions 416 and 418 abut the stopping longitudinal surfaces 448C and 448C' of the third pair of channel members 444C and 444C' and the leg portions 416 and 418 with adjacent fixed flanges 420 and 422 are engaged in the third pair of channel members 444C and 444C'. Such slidable movement causes a first unidirectional axial rotational movement, clockwise in this case, of the rotary cam 440 in unison with an upward movement of the rotary cam 440 until the leg portions 416 and 418 abut the stopping longitudinal surfaces 448C and 448C' of the third pair of channel members 444C and 444C', and the fixed flanges 420 and 422, adjacent to the leg portions 416 and 418, are engaged in the third pair of channel members 444C and 444C'. Specifically, the leg portions 416 and 418 are engaged in the first portions of the third pair of channel members 444C and 444C' and the fixed flanges 420 and 422, adjacent to the leg portions 416 and 418, are engaged in the second portions of the third pair of channel members 444C and 444C'.

Figure 7C:
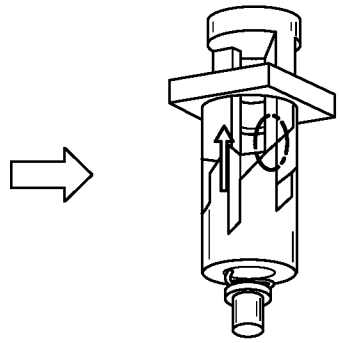

FIG. 7C illustrates the next step of the operation sequence. The external force that was applied on the plunger member 412 is removed. Consequently, under the influence of the upward force exerted at the plunger member 412 by the first biasing member 442, the plunger member 412 is forcibly allowed to move outwardly that causes the leg portions 416 and 418 to withdraw from the first portions of the third pair of channel members 444C and 444C'. The withdrawal of the leg portions 416 and 418 from the third pair of channel members 444C and 444C' results in disengagement of the leg portions 416 and 418 from the stopping longitudinal surfaces 448C and 448C' of the third pair of channel members 444C and 444C'. As the lower edges of the chamfered surfaces of the leg portions 416 and 418 reach the points of contact with the upper edges of the chamfered surfaces 450A and 450A', the third pair of channel members 444C and 444C' disengages the leg portions 416 and 418.

Figure 7D:
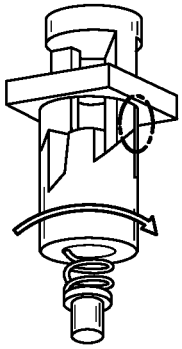

FIG. 7D illustrates the next step of the operation sequence. The disengagement of the leg portions 416 and 418 from the stopping longitudinal surfaces 448C and 448C' of the third pair of channel members 444C and 444C' and the upward force exerted at the rotary cam 440 by the second biasing member 446 causes a slidable movement of the chamfered surfaces of the leg portions 416 and 418 along the chamfered surfaces 450A and 450A' of the first pair of channel members 444A and 444A', and the chamfered surfaces of the fixed flanges 420 and 422 along the chamfered surfaces 450F and 450F' of the third pair of channel members 444C and 444C'. The slidable movement is continued until the fixed flanges 420 and 422 abut the stopping longitudinal surfaces 448C and 448C' of the third pair of channel members 444C and 444C'. Such slidable movement causes a second unidirectional axial rotational movement, clockwise in this case, of the rotary cam 440 in unison with an upward movement of the rotary cam 440 until the fixed flanges 420 and 422 abut the stopping longitudinal surfaces 448C and 448C' of the third pair of channel members 444C and 444C'.

Figure 7E:
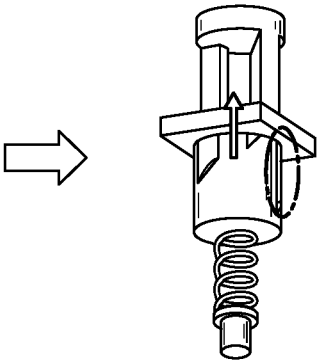

FIG. 7E illustrates the next step of the operation sequence. The upward movement of the rotary cam 440 under the influence of the second biasing member 446 completely engages the fixed flanges 420 and 422 in the first portions of the third pair of channel members 444C and 444C'.

Figure 7F:
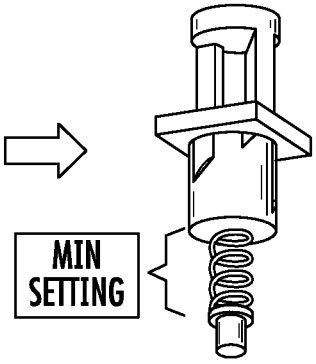
Figure 7G:
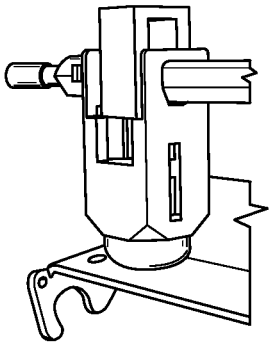
FIGS. 7G and 7H illustrate a third position (at intermediate pressure load setting) and the first position (at minimum pressure load setting) of rotary cam, in accordance with FIGS. 7A-7F, as shown through a longitudinal window of hollow housing of the rotary cam, in accordance with one or more embodiments of the present disclosure.
Figure 7H:
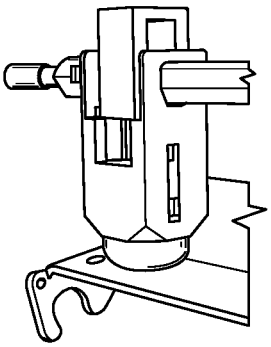

FIG. 7F illustrates the last step of the operation sequence. Under the influence of the upward force exerted at the plunger member 412 by the first biasing member 442, and removal of the external force that was applied on the plunger member 412, the plunger member 412 is forcibly allowed to further move outwardly. Such a state of various components of the first printhead pressure load module 302A defines a first position of the rotary cam 440 along the longitudinal axis with respect to the top end 404A of the hollow housing 404. Such a position of the rotary cam 440 indicates a minimum pressure setting that defines a minimum/no force that can act on the pressure contact member 312 through the second biasing member 446, as the second biasing member 446 in not compressed at all. The first position is shown through the longitudinal window 408 of the hollow housing 404 of the rotary cam 440 as illustrated in FIG. 7H.

The disclosed embodiments encompass numerous advantages. The embodiments, as presented in the present disclosure, disclose a feature for use in a printing apparatus that provides flexibility to adjust the printhead pressure load of the printing apparatus in the most seamless and user-friendly manner, for example, by just pressing and releasing a push button plunger.

The area of pressure contact developed by the printhead due to the disclosed printhead pressure load modules is adequate to produce appropriate contact between the printhead and the print media, thereby resulting in thermal energy transfer for proper image formation. As disclosed herein, there may be three levels of pressure load settings. However, the number may exceed based on increased number of channel members. Consequently, the pressure load on the printhead is sufficient enough to cause optimally printed areas of image on the print media. As the pressure load on the printhead not excessive, the unnecessary abrasion and wear-and-tear of the printhead may be avoided, resulting in long print life of the printhead.

The disclosed printhead pressure load modules neither require complicated sequence of actions to be performed or nor any specialized aid of tool for pressure load adjustment. Thus, the disclosed printhead pressure load modules are quite easy to operate and very user-friendly. Further, for any particular type of print media, the printhead load settings of the disclosed printhead pressure load modules may be standardized. Thus, the hit-and-trial pressure load settings and position of the pressure load modules may be avoided, preventing the print media wastage and ensuring an optimal printing quality at the same time.

Figure 8A:
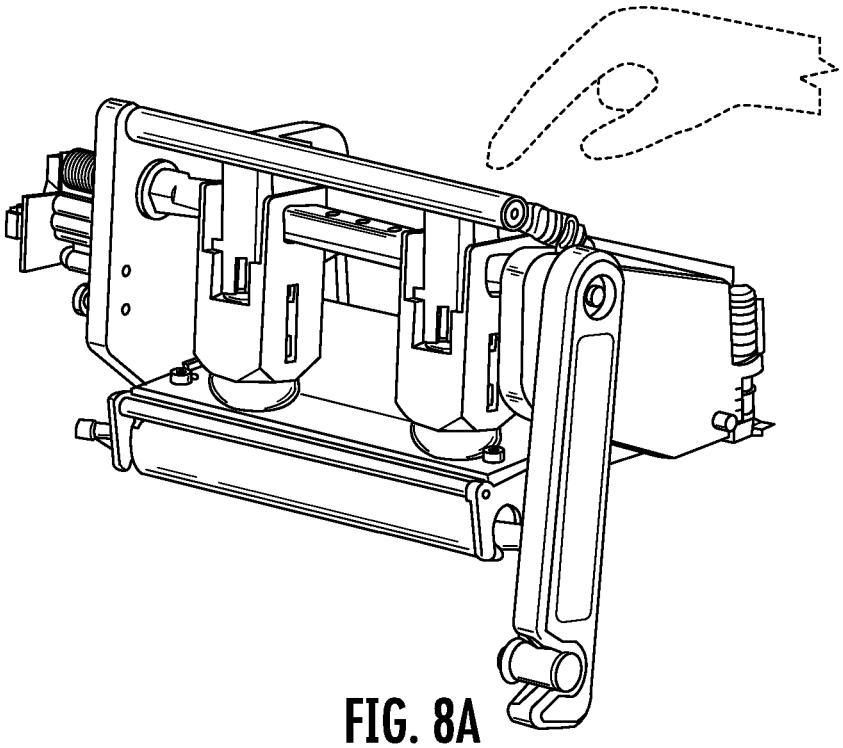
FIGS. 8A and 8B illustrate exemplary techniques for adjustment of the plurality of printhead pressure load module, in accordance with one or more embodiments of the present disclosure.
Figure 8B:
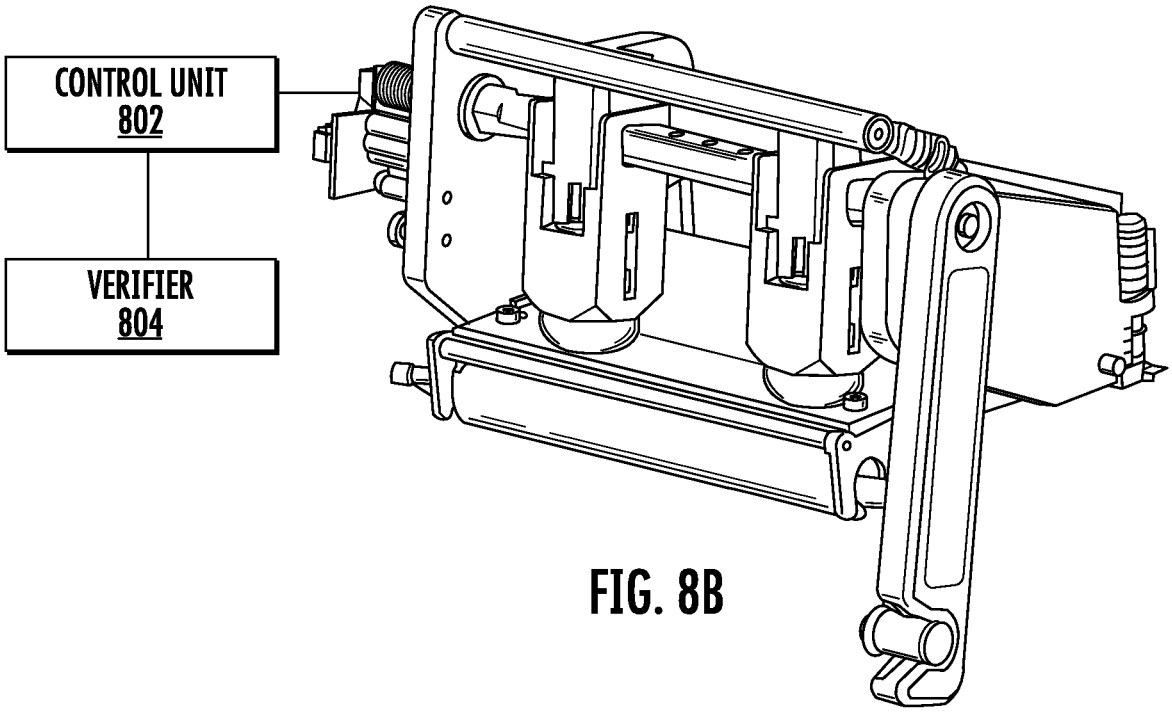

In some example embodiments, certain ones of the operations herein may be modified or further amplified as described below. Moreover, in an embodiment additional optional operations may also be included. It should be appreciated that each of the modifications, optional additions or amplifications described herein may be included with the operations herein either alone or in combination with any others among the features described herein. As illustrated in FIGS. 8A and 8B, the adjustment of the plurality of printhead pressure load module 302 may be performed in accordance with two embodiments. According to one embodiment, the adjustment of the plurality of printhead pressure load module 302 may be performed manually in response to an observation that the print quality of the printing operation is below a threshold quality level. Based on the observation, the operator decides that which portion of the print media 308 requires the adjustment of pressure load. Accordingly, the operator slides one or more of the plurality of printhead pressure load modules 302 along the shaft 304 in the horizontal direction transverse to the web direction A (e.g., in cross web direction B). The operator can further adjust the one or more of the plurality of printhead pressure load modules 302 based on the current quality of the printing operation. For example, if the right portion of the printing operation is very light, one of the plurality of printhead pressure load modules 302 is slid along the shaft 304 towards the right side in the horizontal direction transverse to the web direction A. Once appropriately positioned, the pressure load may be increased at the point of concern (using the printhead pressure load module 302) so that the printing quality exceeds the threshold quality level.

In another embodiment, as illustrated in FIG. 8B, a control unit 802 and a verifier 804 may be communicatively coupled with the printhead pressure load assembly 300. The verifier 804 may be configured to automatically determine the print quality of the printing operation in process. In case the verifier 804 determines that the print quality is below a threshold quality level, it may communicate the corresponding information to the control unit 802. The control unit, based on the feedback received from the verifier 804, may control the adjustment of the plurality of printhead pressure load modules 302 along the shaft 304 in the horizontal direction transverse to the web direction A (e.g., in cross web direction B). The control unit 802 may further adjust one or more of the plurality of printhead pressure load module 302 based on the current quality of the printing operation. Such adjustment may be performed based on configuration information pre-stored in the print buffers of the printing apparatus 100. The adjustment may be performed until the control unit 802 receives a feedback from the verifier 804 that the printing quality of the printing operation exceeds the threshold quality level.

The foregoing method descriptions and the process flow diagrams are provided merely as illustrative examples and are not intended to require or imply that the steps of the various embodiments must be performed in the order presented. As will be appreciated by one of skill in the art the order of steps in the foregoing embodiments may be performed in any order. Words such as "thereafter," "then," "next," etc. are not intended to limit the order of the steps; these words are simply used to guide the reader through the description of the methods. Further, any reference to claim elements in the singular, for example, using the articles "a," "an" or "the" is not to be construed as limiting the element to the singular.

The various illustrative logical blocks, modules, circuits, and algorithm steps described in connection with the embodiments disclosed herein may be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the present disclosure.

The hardware used to implement the various illustrative logics, logical blocks, modules, and circuits described in connection with the aspects disclosed herein may be implemented or performed with a general purpose processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general-purpose processor may be a microprocessor, but, in the alternative, the processor may be any conventional processor, controller, microcontroller, or state machine. A processor may also be implemented as a combination of computing devices, such as, a combination of a DSP and a microprocessor, a plurality of microprocessors, one or more microprocessors in conjunction with a DSP core, or any other such configuration. Alternatively, some steps or methods may be performed by circuitry that is specific to a given function.

While various embodiments in accordance with the principles disclosed herein have been shown and described above, modifications thereof may be made by one skilled in the art without departing from the spirit and the teachings of the disclosure. The embodiments described herein are representative only and are not intended to be limiting. Many variations, combinations, and modifications are possible and are within the scope of the disclosure. Alternative embodiments that result from combining, integrating, and/or omitting features of the embodiment(s) are also within the scope of the disclosure. Accordingly, the scope of protection is not limited by the description set out above, but is defined by the claims which follow, that scope including all equivalents of the subject matter of the claims. Each and every claim is incorporated as further disclosure into the specification and the claims are embodiment(s) of the present disclosure(s). Furthermore, any advantages and features described above may relate to specific embodiments, but shall not limit the application of such issued claims to processes and structures accomplishing any or all of the above advantages or having any or all of the above features.

In addition, the section headings used herein are provided for consistency with the suggestions under 37 C.F.R. 1.77 or to otherwise provide organizational cues. These headings shall not limit or characterize the disclosure(s) set out in any claims that may issue from this disclosure. For instance, a description of a technology in the "Background" is not to be construed as an admission that certain technology is prior art to any disclosure(s) in this disclosure. Neither is the "Summary" to be considered as a limiting characterization of the disclosure(s) set forth in issued claims. Furthermore, any reference in this disclosure to "disclosure" in the singular should not be used to argue that there is only a single point of novelty in this disclosure. Multiple disclosures may be set forth according to the limitations of the multiple claims issuing from this disclosure, and such claims accordingly define the disclosure(s), and their equivalents, that are protected thereby. In all instances, the scope of the claims shall be considered on their own merits in light of this disclosure, but should not be constrained by the headings set forth herein.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

Many modifications and other embodiments of the disclosures set forth herein will come to mind to one skilled in the art to which these disclosures pertain having the benefit of teachings presented in the foregoing descriptions and the associated drawings. Although the figures only show certain components of the apparatus and systems described herein, it is understood that various other components may be used in conjunction with the supply management system. Therefore, it is to be understood that the disclosures are not to be limited to the specific embodiments disclosed and that modifications and other embodiments are intended to be included within the scope of the appended claims. For example, the various elements or components may be combined or integrated in another system or certain features may be omitted or not implemented. Moreover, the steps in the method described above may not necessarily occur in the order depicted in the accompanying diagrams, and in some cases one or more of the steps depicted may occur substantially simultaneously, or additional steps may be involved. Although specific terms are employed herein, they are used in a generic and descriptive sense only and not for purposes of limitation.

What is claimed is:

1. A printing apparatus comprising:

a printhead assembly extending a printhead width in a direction transverse to a web direction;

a plurality of printhead pressure load modules adjustable on a shaft of a printhead pressure load assembly and engaged with a printhead member, the shaft extending in the direction transverse to the web direction, each of the plurality of printhead pressure load modules comprising:

a hollow housing having fixed flanges defined on an inner surface and extending along a longitudinal axis of the printhead pressure load module;

a plunger member, slidably mounted through a top end of the hollow housing, wherein the plunger member has a cap portion and leg portions, the leg portions extending along the longitudinal axis of the printhead pressure load module and movably positioned adjacent to the fixed flanges;

a rotary cam movably engaged in the hollow housing and coupled with the cap portion of the plunger member through a first biasing member, opposite ends of the first biasing member being secured to a bottom surface of the cap portion of the plunger member and a top surface of the rotary cam, respectively, the rotary cam comprising a plurality of channel members defined at an outer surface of the rotary cam and extending from a top end of the rotary cam along the longitudinal axis of the printhead pressure load module, each channel member having a depth that is different from a depth of an adjacent channel member, wherein a movement of the plunger member inwardly through the top end of the hollow housing and a resultant engagement of at least the fixed flanges with two diametrically opposite channel members having defined depths defines a position of the rotary cam along the longitudinal axis with respect to the top end of the hollow housing, and a pressure contact member is positioned towards a bottom end of the hollow housing and engaged with a bottom end of a cap portion of the rotary cam through a second biasing member such that a change in the position of the rotary cam defines a force that acts on the pressure contact member through the second biasing member and causes the pressure contact member to adjust a load on the printhead assembly engaged with the printhead pressure load module.

2. The printing apparatus according to claim 1, wherein the plurality of channel members comprises at least three pairs of channel members, each pair of the at least three pairs of channel members have identical channel members, equidistant from an axis of rotation of the rotary cam, and defined diametrically opposite to each other on the outer surface of the rotary cam.

3. The printing apparatus according to claim 2, wherein the at least three pairs of the plurality of channel members are engaged successively by the fixed flanges that defines the position of the rotary cam along the longitudinal axis with respect to the top end of the hollow housing, wherein the position of the rotary cam along the longitudinal axis defines a magnitude of the force that acts on the pressure contact member through the second biasing member.

4. The printing apparatus according to claim 1, wherein a periphery of each channel member of the plurality of channel members is defined by one or more longitudinal surfaces and one or more chamfered surfaces, wherein a first portion of the periphery defines a depth of corresponding channel member.

5. The printing apparatus according to claim 4, wherein one of the one or more longitudinal surfaces in each channel member is a stopping longitudinal surface configured to stop a rotational movement of the rotary cam.

6. The printing apparatus according to claim 4, wherein at least one of the one or more chamfered surfaces in each channel member is defined along a helical path around the outer surface of the rotary cam that defines the depth of the corresponding channel member, wherein others of the one or more chamfered surfaces in each channel member extend from the top surface of the rotary cam to other longitudinal surface of the corresponding channel member.

7. The printing apparatus according to claim 1, wherein a longitudinal surface of a channel member is defined by an upper edge of a chamfered surface of a channel member of an axially backward channel member and a lower edge of a chamfered surface of the channel member, wherein in an instance when both the leg portions and the fixed flanges are engaged in the channel member, the longitudinal surface of the channel member is a stopping surface abutting the leg portion, wherein in an instance when the leg portion is withdrawn due to movement of the plunger member outwardly under an influence of the first biasing member, the longitudinal surface of the channel member acts as a stopping surface abutting the fixed flange.

8. The printing apparatus according to claim 1, wherein a top portion of each of the fixed flanges is extended as a circumferentially structured stop member defined on the inner surface of the hollow housing, and the ending portion is having a chamfered surface is configured to abut a chamfered surface of the rotary cam and move the rotary cam in a downward direction.

9. The printing apparatus according to claim 1, wherein the hollow housing includes a longitudinal window showing current position of the rotary cam.

10. The printing apparatus according to claim 1, wherein the printhead member is adjusted in one of a printing position or loading position, wherein a printhead bracket of the printhead member comprises a horizontal surface and an inclined surface.

11. The printing apparatus according to claim 10, wherein in an instance when the printing apparatus is in printing mode and the printhead member is adjusted in the printing position, the plurality of printhead pressure load modules are aligned vertically along the longitudinal axis and the pressure contact members are engaged with the horizontal surface of the printhead bracket.

12. The printing apparatus according to claim 10, wherein in an instance when the printing apparatus is in loading mode and the printhead member is adjusted in the loading position, the plurality of printhead pressure load modules rotate in reverse web direction around the shaft and the pressure contact members are slidably engaged with the inclined surface of the printhead bracket.

13. A printhead pressure load module comprising:

a hollow housing having fixed flanges defined on an inner surface and extending along a longitudinal axis of the printhead pressure load module;

a plunger member, slidably mounted through a top end of the hollow housing, wherein the plunger member has a cap portion and leg portions, the leg portions extending along the longitudinal axis of the printhead pressure load module and movably positioned adjacent to the fixed flanges;

a rotary cam movably engaged in the hollow housing and coupled with an inner surface of the cap portion of the plunger member through a first biasing member secured to the cap portion, the rotary cam comprising a plurality of channel members defined at an outer surface of the rotary cam and extending from a top end of the rotary cam along the longitudinal axis of the printhead pressure load module, each channel member having a depth that is different from a depth of an adjacent channel member, wherein a movement of the plunger member inwardly through the top end of the hollow housing and a resultant engagement of at least the fixed flanges with two diametrically opposite channel members having defined depths defines a position of the rotary cam along the longitudinal axis with respect to the top end of the hollow housing, and a pressure contact member is positioned towards a bottom end of the hollow housing and engaged with a bottom end of a cap portion of the rotary cam through a second biasing member such that a change in the position of the rotary cam defines a force that acts on the pressure contact member through the second biasing member and causes the pressure contact member to adjust a load on a printhead assembly engaged with the printhead pressure load module.

14. The printhead pressure load module according to claim 13, wherein the plurality of channel members comprises at least three pairs of channel members, each pair of the at least three pairs of channel members have identical channel members, equidistant from an axis of rotation of the rotary cam and defined diametrically opposite to each other on the outer surface of the rotary cam.

15. The printhead pressure load module according to claim 14, wherein a periphery of each of the plurality of channel members is defined by one or more longitudinal surfaces and one or more chamfered surfaces, wherein a portion of the periphery defines a depth of corresponding channel member.

16. The printhead pressure load module according to claim 15, wherein one of the one or more longitudinal surfaces in each channel member is a stopping longitudinal surface configured to stop a rotational movement of the rotary cam, wherein at least one of the one or more chamfered surfaces in each channel member is defined along a helical path around the outer surface of the rotary cam that defines the depth of the corresponding channel member, wherein others of the one or more chamfered surfaces in each channel member extend from the top surface of the rotary cam to other longitudinal surface of the corresponding channel member.

17. The printhead pressure load module according to claim 15, wherein the at least three pairs of the plurality of channel member are engaged successively by the fixed flanges that defines the position of the rotary cam along the longitudinal axis with respect to the top end of the hollow housing, wherein the position of the rotary cam along the longitudinal axis defines a magnitude of the force that acts on the pressure contact member through the second biasing member.

18. The printhead pressure load module according to claim 13, wherein a longitudinal surface of a channel member is defined by an upper edge of a chamfered surface of a channel member of an axially prior channel member and a lower edge of a chamfered surface of the channel member, wherein in an instance when both the leg portions and the fixed flanges are engaged in the channel member, the longitudinal surface of the channel member is a stopping surface abutting the leg portion, wherein in an instance when the leg portion is withdrawn due to movement of the plunger member outwardly under an influence of the first biasing member, the longitudinal surface of the channel member is a stopping surface abutting the fixed flange.

19. The printhead pressure load module to claim 13, wherein a top portion of each of the fixed flanges is extended as a circumferentially structured stop member defined on the inner surface of the hollow housing, and the ending portion is having a chamfered surface is configured to abut a chamfered surface of the rotary cam and move the rotary cam in a downward direction.

20. The printhead pressure load module to claim 13, wherein the hollow housing includes a longitudinal window exposing current position of the rotary cam.

* * * * *